US012644665B2

(12) United States Patent
Underwood et al.

(10) Patent No.: US 12,644,665 B2
(45) Date of Patent: Jun. 2, 2026

(54) FIREARM BUFFER TUBE COVER ASSEMBLIES

(71) Applicants: James Matthew Underwood, Kennesaw, GA (US); Alexander Benjamin Wallace Langub, Roswell, GA (US); Larry Cullen Underwood, Canton, GA (US)

(72) Inventors: James Matthew Underwood, Kennesaw, GA (US); Alexander Benjamin Wallace Langub, Roswell, GA (US); Larry Cullen Underwood, Canton, GA (US)

( * ) Notice: Subject to any disclaimer, the term of this patent is extended or adjusted under 35 U.S.C. 154(b) by 25 days.

(21) Appl. No.: 18/541,720

(22) Filed: Dec. 15, 2023

(65) Prior Publication Data

US 2024/0200900 A1 Jun. 20, 2024

Related U.S. Application Data

(60) Provisional application No. 63/433,690, filed on Dec. 19, 2022.

(51) Int. Cl.
*F41C 23/12* (2006.01)
*F41A 11/02* (2006.01)

(52) U.S. Cl.
CPC ..... *F41C 23/12* (2013.01); *F41A 11/02* (2013.01)

(58) Field of Classification Search
CPC ..... F41A 11/02; F41A 11/04; F41C 23/04; F41C 23/06; F41C 23/12; F41C 23/14
USPC ..... 42/71.01, 72, 73
See application file for complete search history.

(56) References Cited

U.S. PATENT DOCUMENTS

| | | | | |
|---|---|---|---|---|
| 5,173,564 | A | 12/1992 | Hammond, Jr. | |
| 6,651,371 | B2 | 11/2003 | Fitzpatrick et al. | |
| 7,762,018 | B1 | 7/2010 | Fitzpatrick et al. | |
| 8,397,414 | B2 | 3/2013 | Walters | |
| 9,109,855 | B1 * | 8/2015 | Kincel | F41C 23/20 |
| 11,262,158 | B2 | 3/2022 | Cahill et al. | |
| 11,703,304 | B2 | 7/2023 | Hannah | |
| 2011/0173863 | A1 * | 7/2011 | Ingram | F41C 23/14 42/74 |
| 2012/0000109 | A1 * | 1/2012 | Zusman | F41C 23/14 42/71.01 |
| 2012/0174456 | A1 * | 7/2012 | DePierro | F41C 23/22 42/71.01 |
| 2013/0180148 | A1 * | 7/2013 | Rogers | F41C 23/04 42/73 |
| 2018/0003459 | A1 * | 1/2018 | Miller | B21D 22/00 |
| 2019/0017777 | A1 * | 1/2019 | Wilson | F41C 23/14 |
| 2019/0137213 | A1 * | 5/2019 | Miller | F41C 23/14 |
| 2020/0240743 | A1 * | 7/2020 | Cahill | F41C 23/14 |
| 2021/0018296 | A1 * | 1/2021 | Faifer | F41C 23/04 |
| 2024/0027152 | A1 * | 1/2024 | Hill | F16F 1/34 |

* cited by examiner

*Primary Examiner* — Troy Chambers
*Assistant Examiner* — Benjamin S Gomberg

(57) ABSTRACT

A buffer tube cover assembly includes a cover base assembly and an insert attached to a rear side of the cover base assembly. The cover base assembly includes a cover tube, a lever, a buffer locating portion, a spring, and at least one pin. The insert includes at least one forward protruding member disposed inside the cover base assembly.

20 Claims, 23 Drawing Sheets

FIREARM BUFFER TUBE COVER ASSEMBLIES

CROSS REFERENCE TO RELATED APPLICATION

This application is related to and claims priority benefit from U.S. Provisional Application No. 63/433,690 ("the '690 application"), filed on Dec. 19, 2022. The '690 application is hereby incorporated in its entirety by this reference.

FIELD OF THE INVENTION

The field of the invention relates to buffer tube cover assemblies for firearms, particularly modular systems designed to be compatible with stocks and braces swapped by the user.

BACKGROUND

Many modern firearms are designed with a collapsible or folding shoulder stock for improved ergonomics which can also make the firearm more compact for storage, carrying, and/or concealment. For example, law enforcement or security details may need firearms with greater capabilities than typical handguns but may also require inconspicuous storage and carrying of such firearms. Many firearms and related accessories are designed for compatibility with the AR-15 variant (civilian) or M16/M4 (military) firearm platform (i.e., collectively AR-15 style firearms). Many of these products follow traditional designs based on industry standards and/or military specification (milspec). However, many of the existing components are not compatible and/or are not legal with specific configurations. For example, AR-15 style firearms with barrels shorter than 16" may be classified as a pistol in certain circumstances. A popular accessory for AR-15 style firearms for some consumers is a shoulder stock that attaches to a buffer tube of the firearm. In cases where the firearm has a shorter barrel and is classified as a pistol, the consumer may wish to install an arm brace in place of a shoulder stock. In addition, if a consumer pays the requisite fee to the Bureau of Alcohol, Tobacco, Firearms and Explosives (BATFE) for a National Firearms Act (NFA) registration to legally own/operate the firearm as a short barrel rifle, the consumer may wish to install a shoulder stock on the firearm (and not an arm brace). Furthermore, because the BATFE has a history of changing rules with little or no notice, a consumer may need a modular assembly that can be modified in order to comply with current rules.

To increase comfort, maneuverability, and ergonomics while maintaining legal status without implicating the NFA, it may be desirable to design new modular buffer tube cover assemblies that can be adapted for multiple configurations including shoulder stocks, arm braces, and various other options.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a buffer tube cover assembly comprises: a cover base assembly; and an insert attached to a rear side of the cover base assembly, wherein: the cover base assembly comprises a cover tube, a lever, a buffer locating portion, a spring, and at least one pin; the insert comprises at least one forward protruding member disposed inside the cover base assembly.

DETAILED DESCRIPTION

Figure 1A:
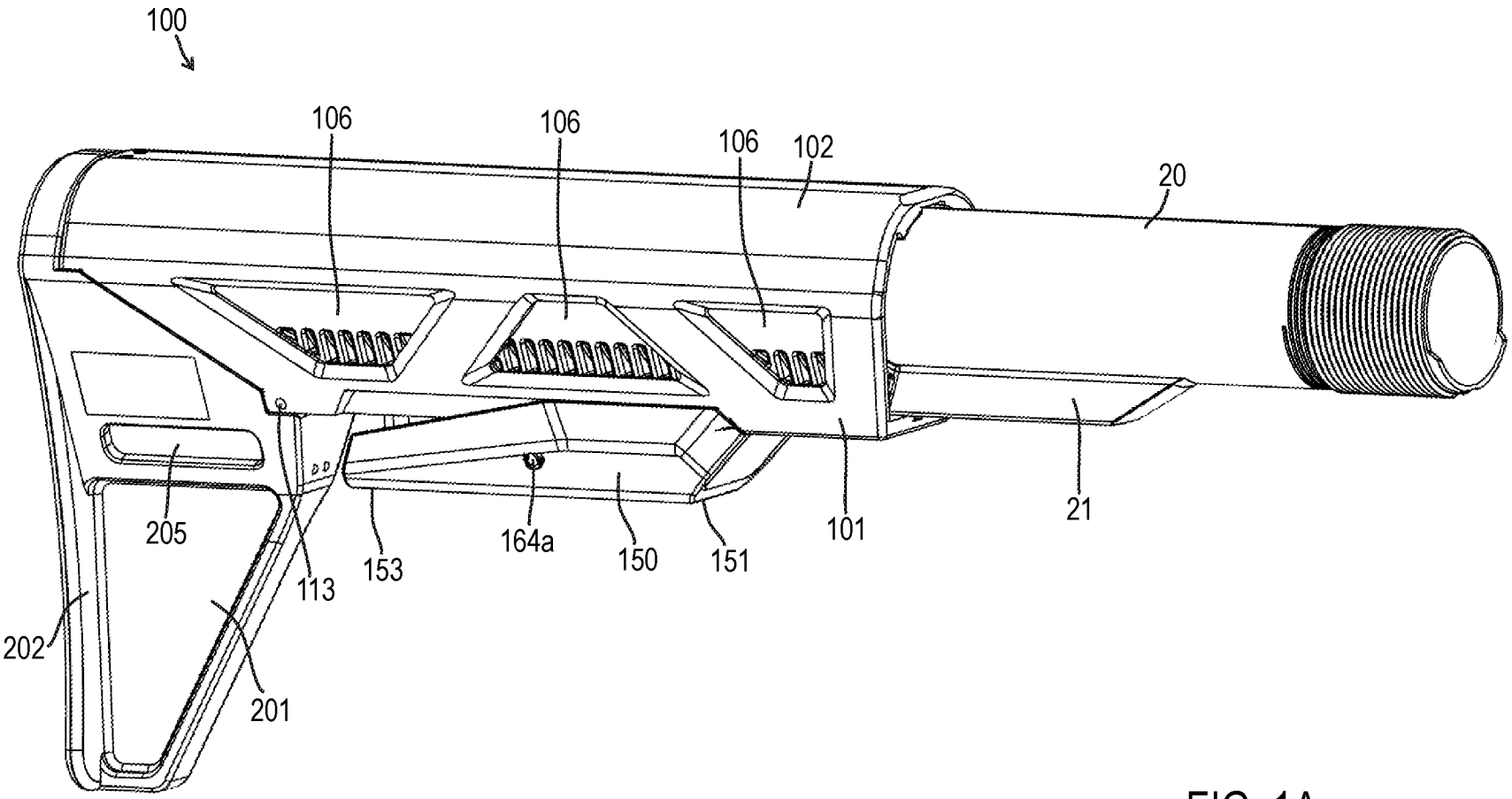
FIG. 1A is a front perspective view of a buffer tube cover assembly with a stock insert according to certain embodiments of the present invention.
Figure 1B:
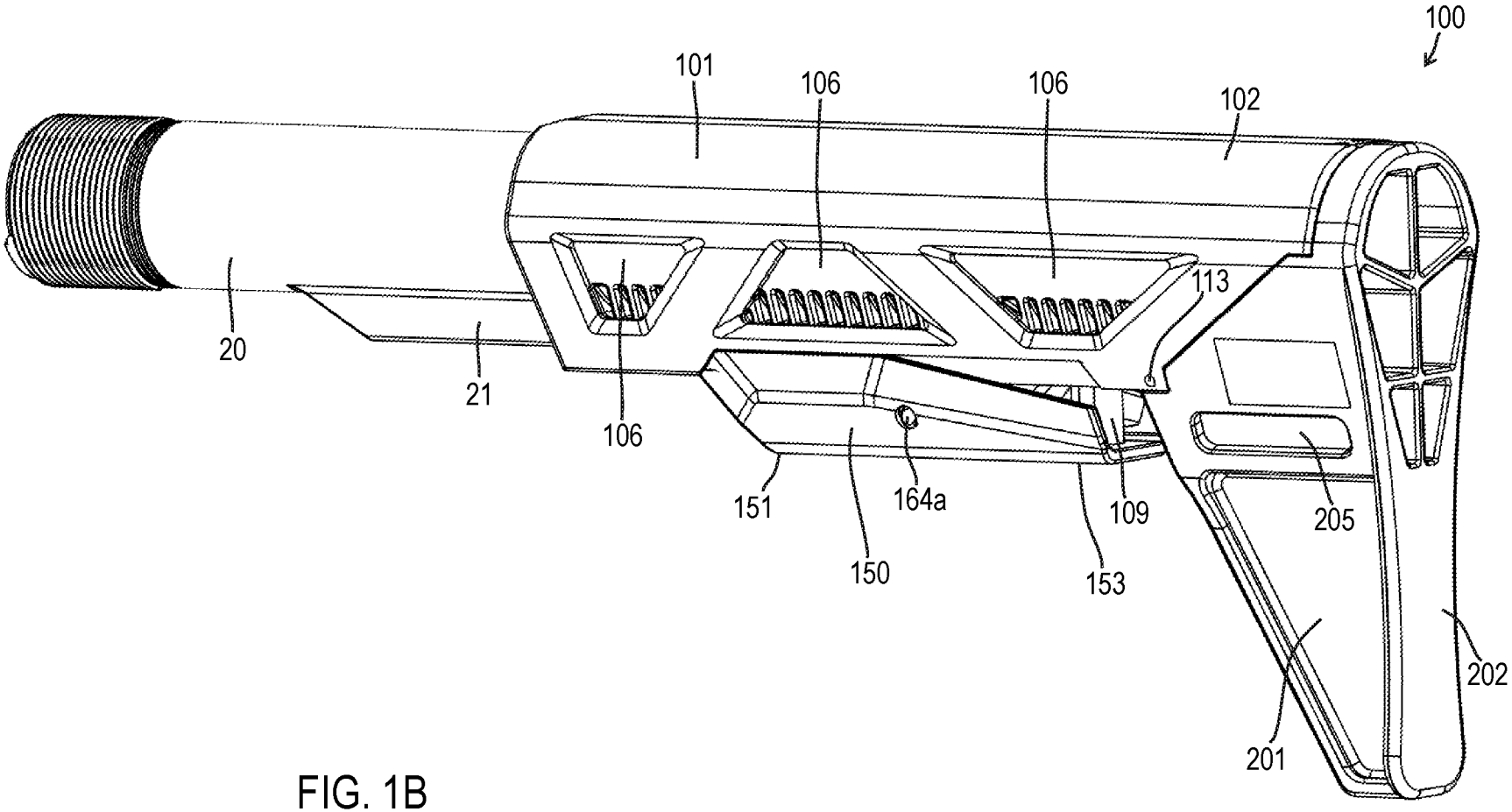
FIG. 1B is a rear perspective view of the buffer tube cover assembly of FIG. 1A.
Figure 2A:
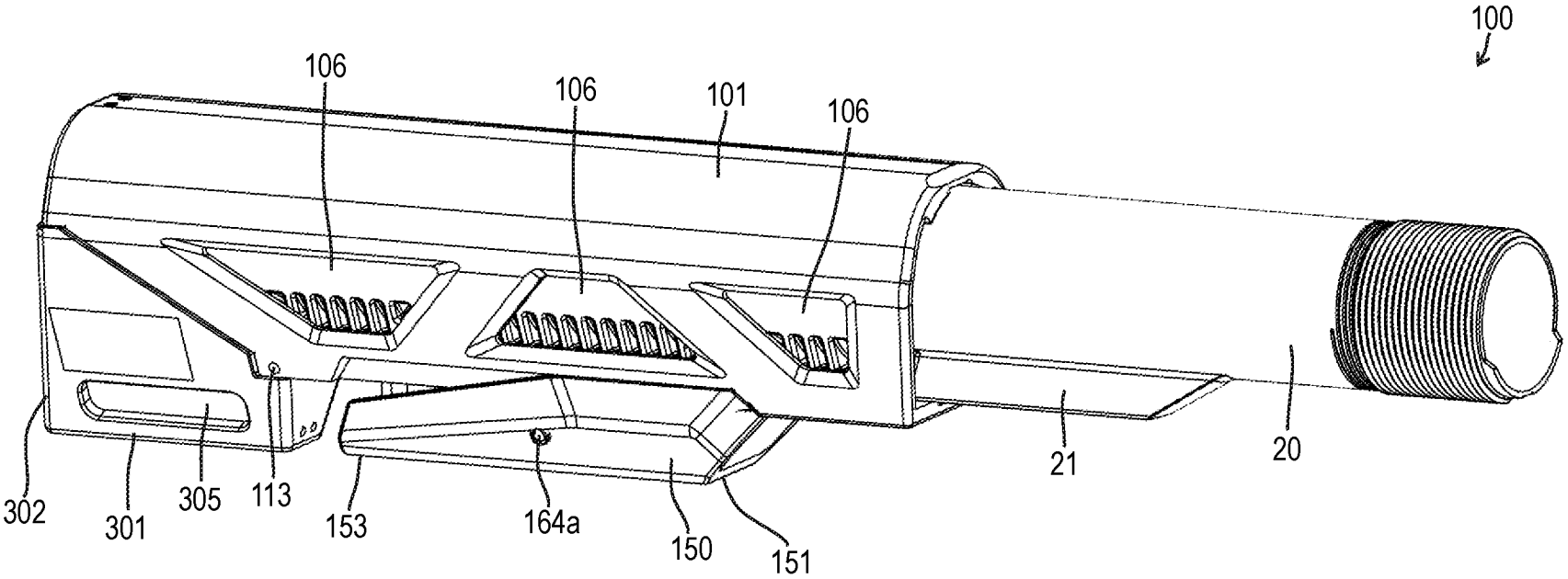
FIG. 2A is a front perspective view of a buffer tube cover assembly with a featureless insert according to certain embodiments of the present invention.
Figure 2B:
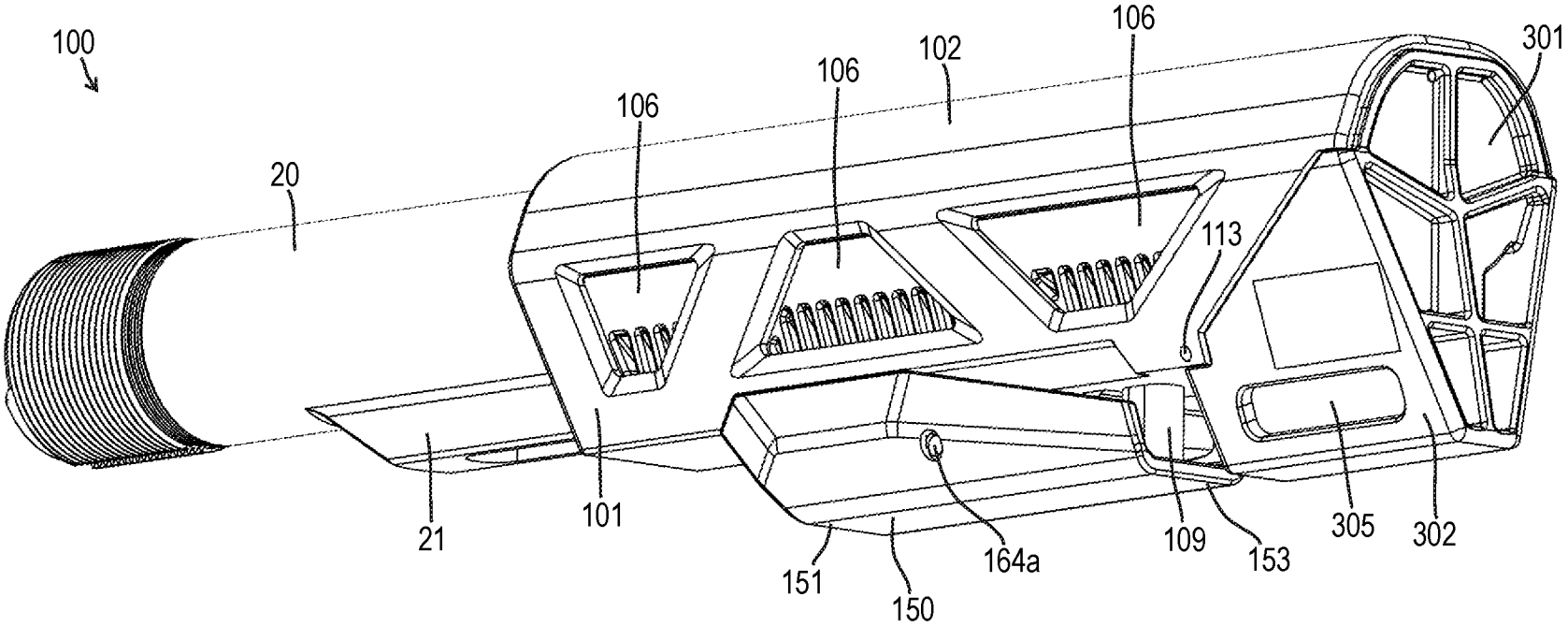
FIG. 2B is a rear perspective view of the buffer tube cover assembly of FIG. 2A.
Figure 3A:
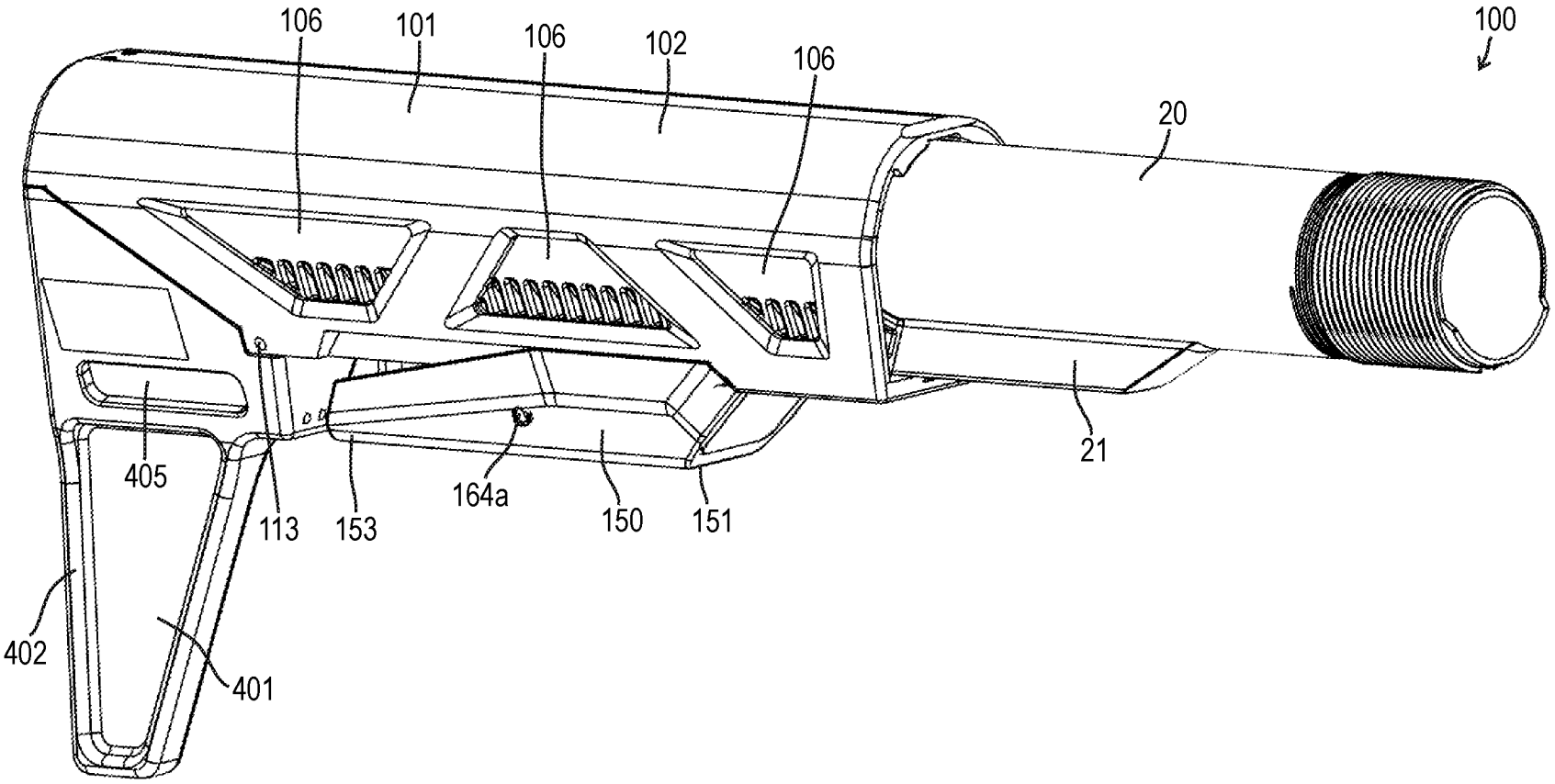
FIG. 3A is a front perspective view of a buffer tube cover assembly with an arm brace insert according to certain embodiments of the present invention.
Figure 3B:
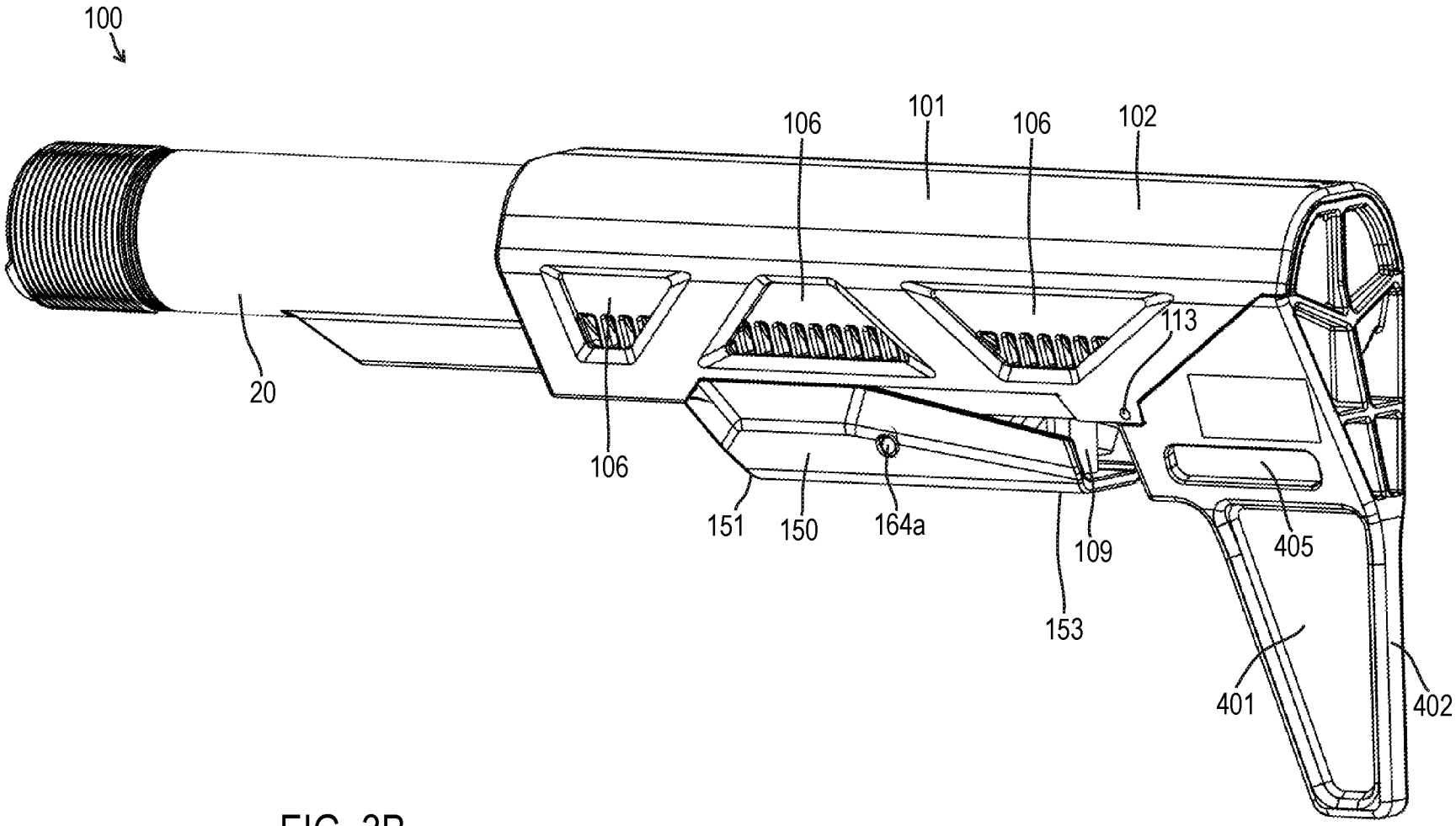
FIG. 3B is a rear perspective view of the buffer tube cover assembly of FIG. 3A.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In some embodiments, a buffer tube cover assembly 100 attaches to a buffer tube 20 and includes a cover base assembly 101 along with one or more inserts. The insert(s) are located on a rear side of the cover base assembly 101 and, as described below, a portion of the insert(s) may be disposed inside the cover base assembly 101. The one or more inserts may include at least one of a stock insert 201, a featureless insert 301, and/or an arm brace insert 401 (see FIGS. 1A-3B and 8). Other inserts may be included such as simple blade-style arm or pistol brace designs, arm braces designed with contoured surfaces for adapting to a user's arm, arm braces designed with straps or other provisions for attaching to a user's arm, precision rifle stocks, rifle stocks with adjustable modules (cheek riser, rear length of pull, lower monopod, etc.), and/or any other appropriate concept. The buffer tube cover assembly 100 may be designed as a modular system such that the insert(s) can be removed, replaced, attached, and/or swapped by the end user or consumer. For example, the user may operate a firearm where the buffer tube cover assembly 100 includes the attached featureless insert 301 and may subsequently decide to remove the featureless insert 301 and install the stock insert 201 or the arm brace insert 401. In other embodiments, the buffer tube cover assembly 100 is designed to have the cover base assembly 101 with one insert (e.g., one of the stock insert 201, the featureless insert 301, or the arm brace insert 401) installed during manufacturing process such that the insert is not designed to be removed or disassembled from the cover base assembly 101.

As shown in FIGS. 4A-4G, 8, 11A, and 11B, the cover base assembly 101 may include a cover tube 102, a lever 150, a buffer locating portion 160, a spring 162, and at least one pin 164. In some embodiments, the cover tube 102 includes a forward end 103, an aft end 104, an internal cavity 105, at least one opening 106, at least one inner protrusion 107, at least one positioning member 108, a lever motion stop member 109, a cylindrical member 110, a hole 111 through the cylindrical member 110, and a slot 112. The lever 150 may include a forward end 151, an aft end 153, a hole 154, an internal boss 155, and a slot 156. The at least one opening 106 may be shaped as a polygon and/or as any other appropriate shape. For example, the at least one opening 106 may be shaped as a rectangle, a trapezoid, a rhombus, an isosceles trapezoid, a parallelogram, a triangle, a pentagon, a hexagon, a circle, a decagon, and/or any other appropriate shape.

In some embodiments, the at least one pin 164 includes a first pin 164*a* that dictates movement of the lever 150 and a second pin 164*b* that dictates movement of the buffer locating portion 160. The movement of the lever 150 may include rotation about the axis of the first pin 164*a* such that the pin 164*a* is located in (i) hole 111 of the cover tube 102 (see FIG. 4E) and (ii) hole 154 of the lever 150 (see FIGS. 4F and 4G). The movement of the buffer locating portion 160 may include movement of the second pin 164*b* within slot 112 of the cover tube 102 (see FIG. 4E) where the second pin 164*b* is also engaged within slot 156 of the lever 150 (see FIG. 4G).

Figure 4A:
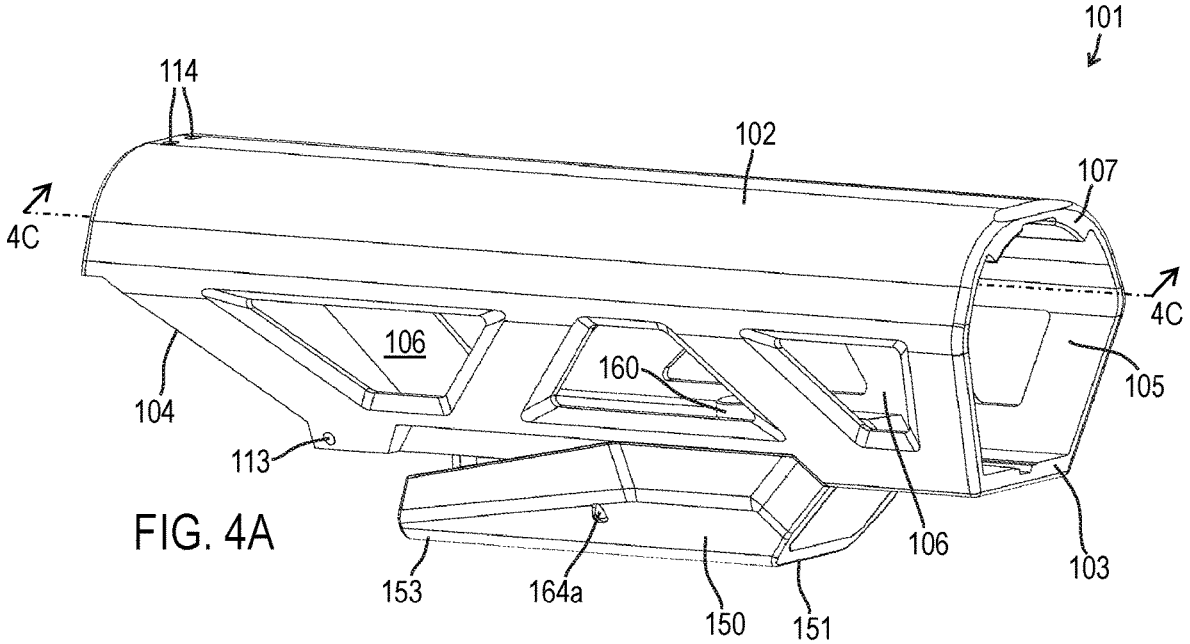
FIG. 4A is a front perspective view of a cover base assembly of the buffer tube cover assembly of FIG. 1A.
Figure 4B:
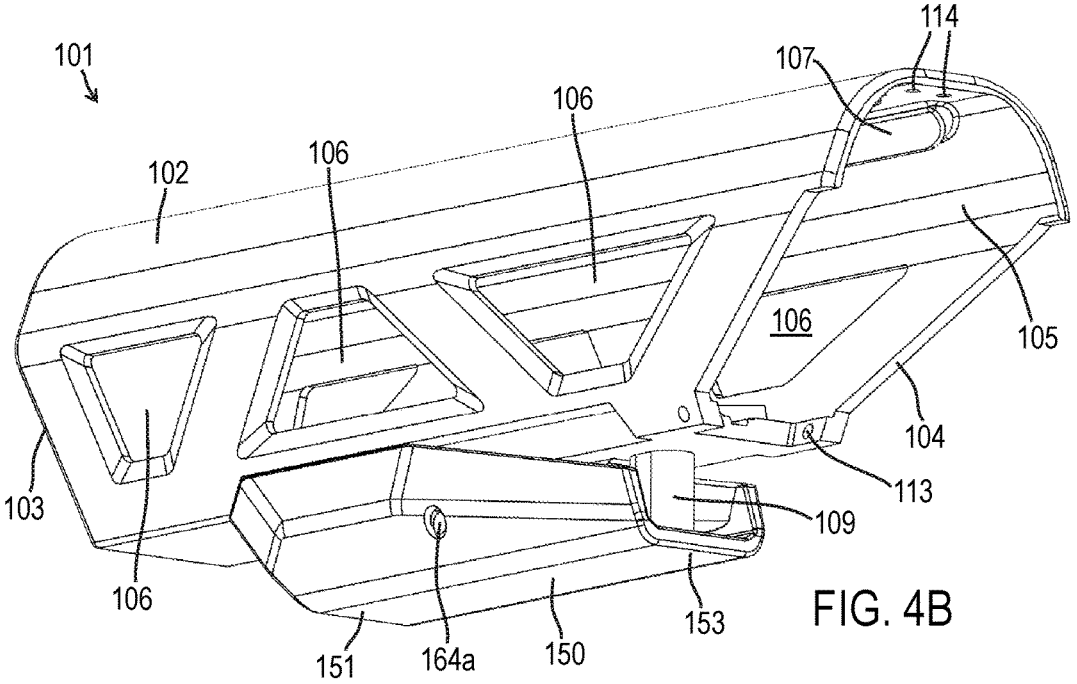
FIG. 4B is a rear perspective view of the cover base assembly of FIG. 4A.
Figure 4C:
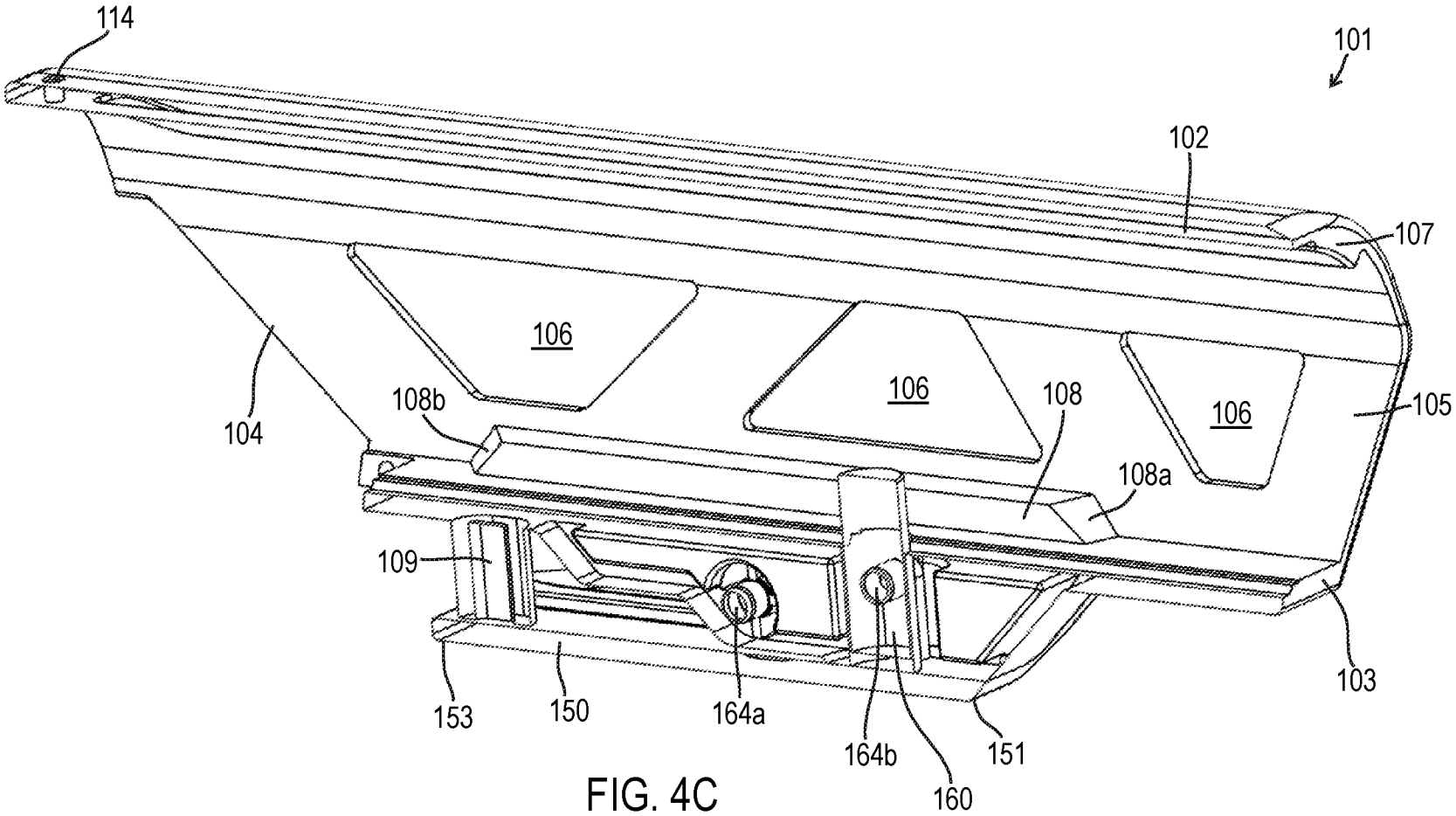
FIG. 4C is a cross-section view of the cover base assembly of FIG. 4A.
Figure 4D:
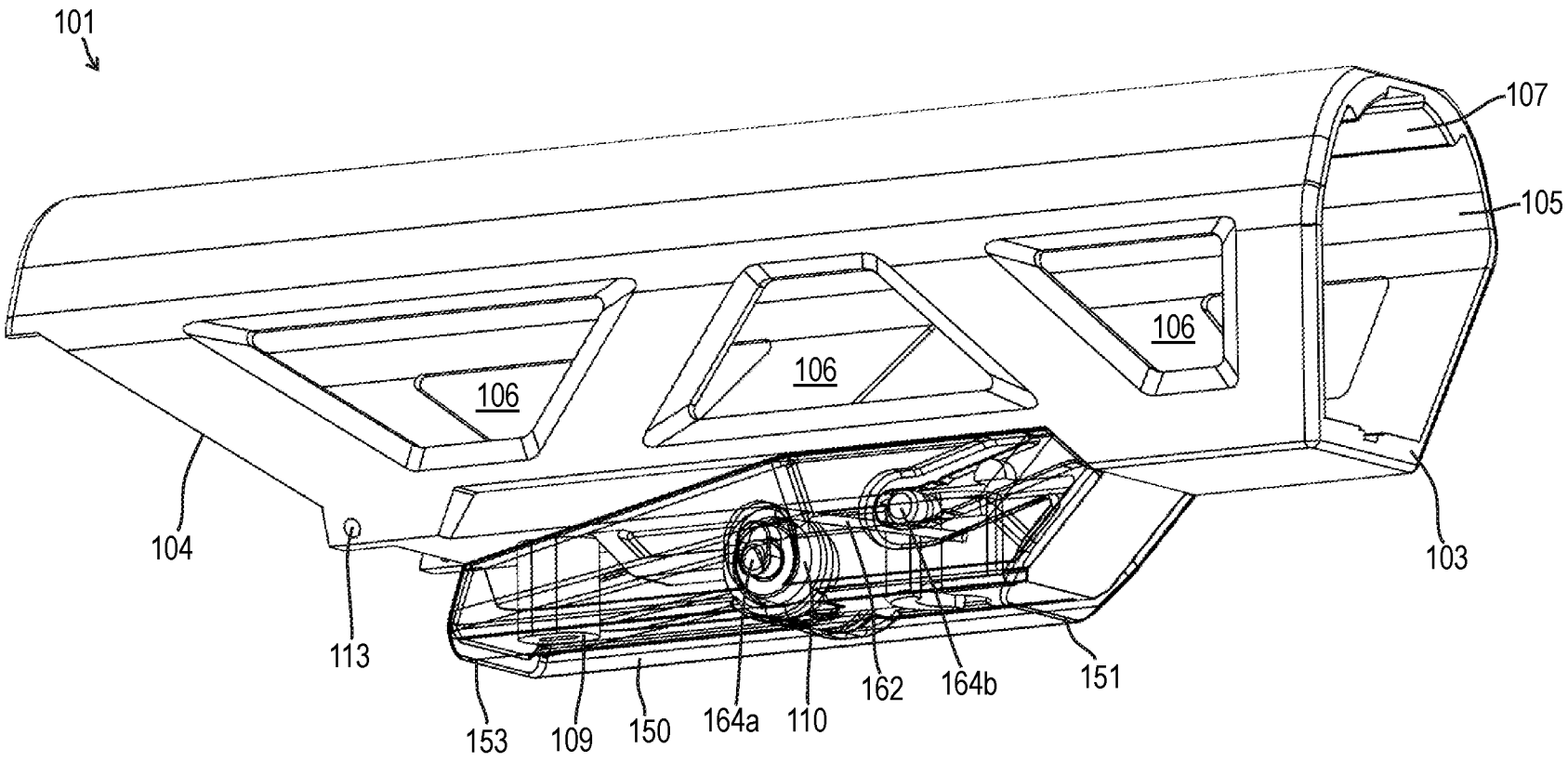
FIG. 4D is a bottom perspective view of the cover base assembly of FIG. 4A.
Figure 4E:
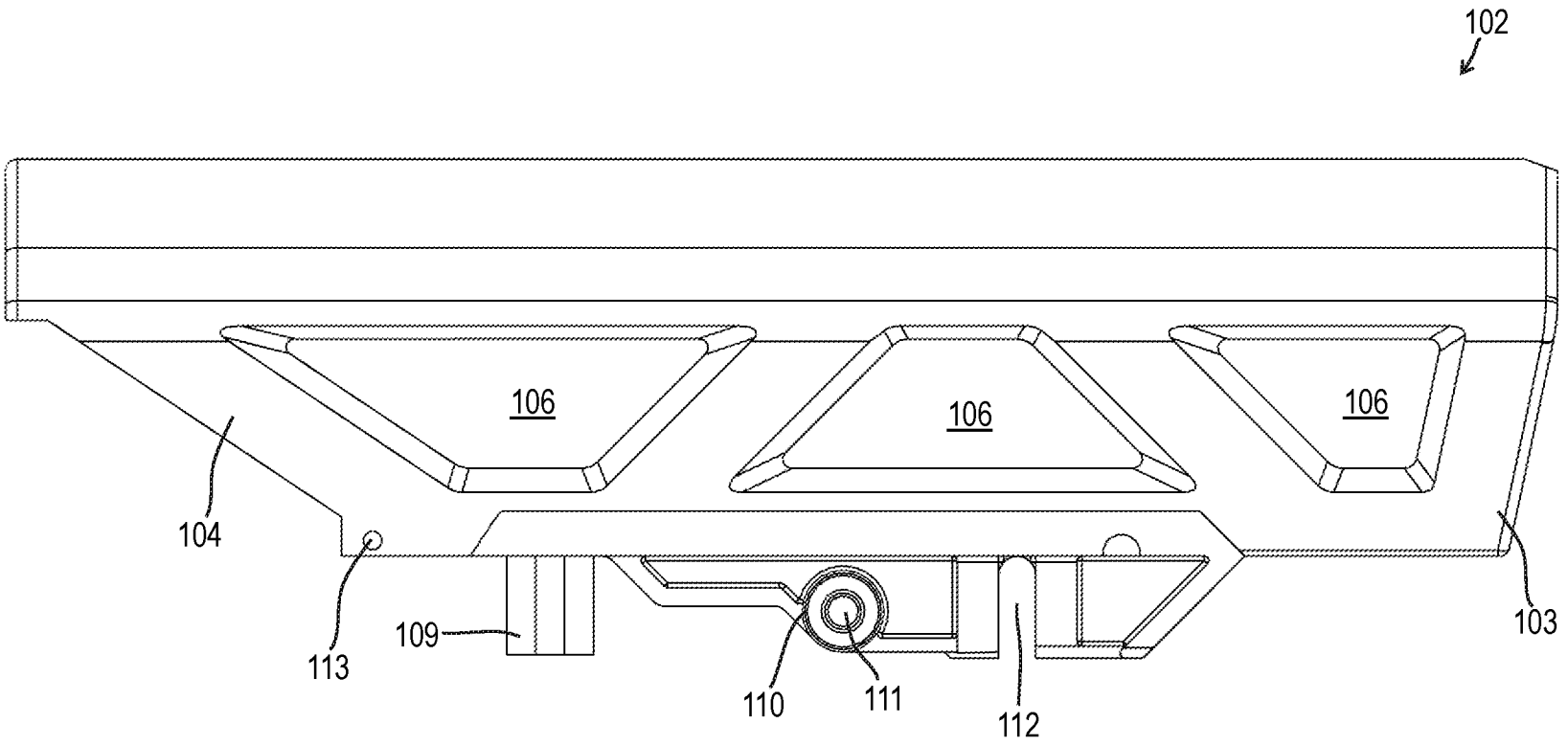
FIG. 4E is a side view of a cover tube of the cover base assembly of FIG. 4A.
Figure 4F:
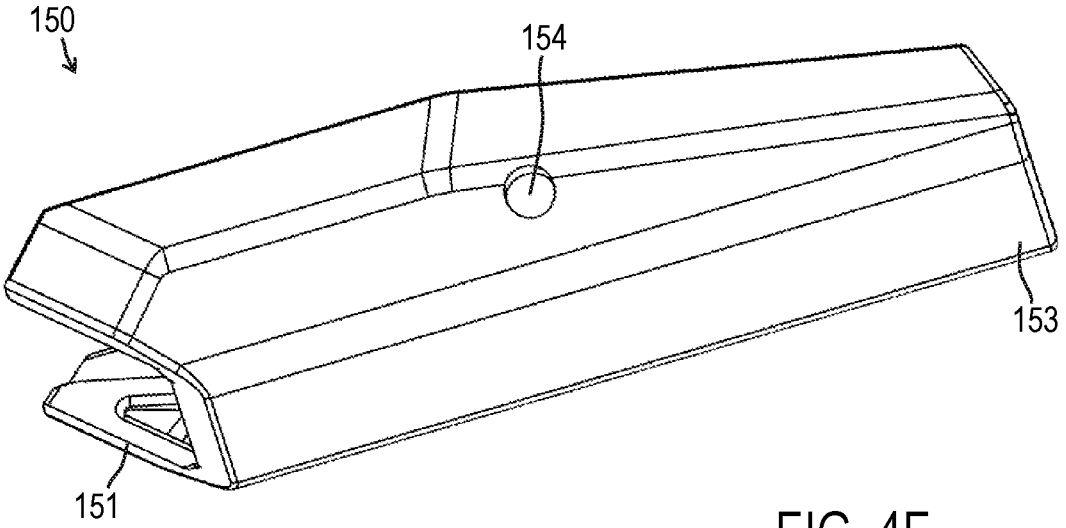
FIG. 4F is a bottom perspective view of a lever of the cover base assembly of FIG. 4A.
Figure 4G:
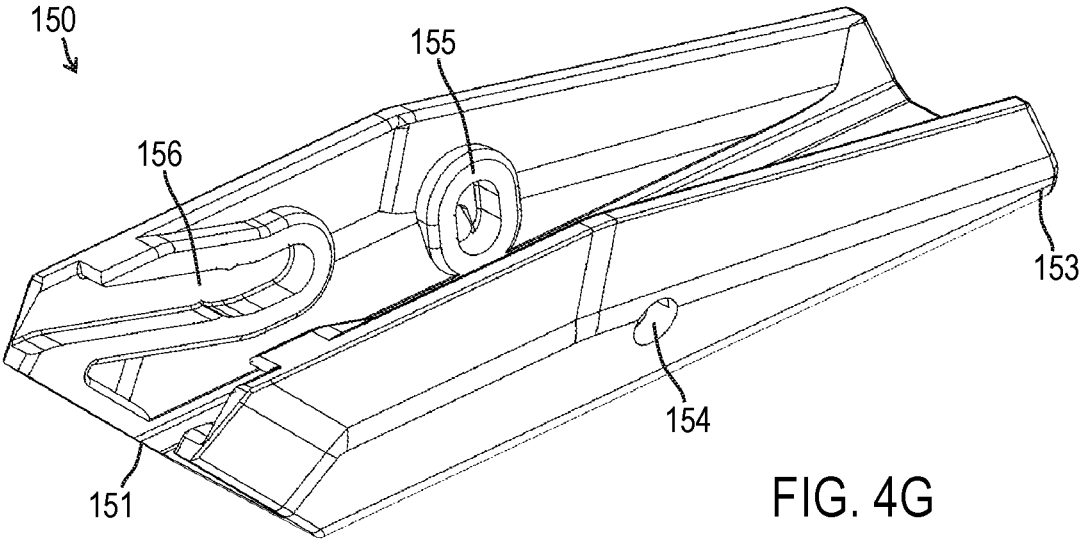
FIG. 4G is a top perspective view of the lever of FIG. 4F.
Figure 5A:
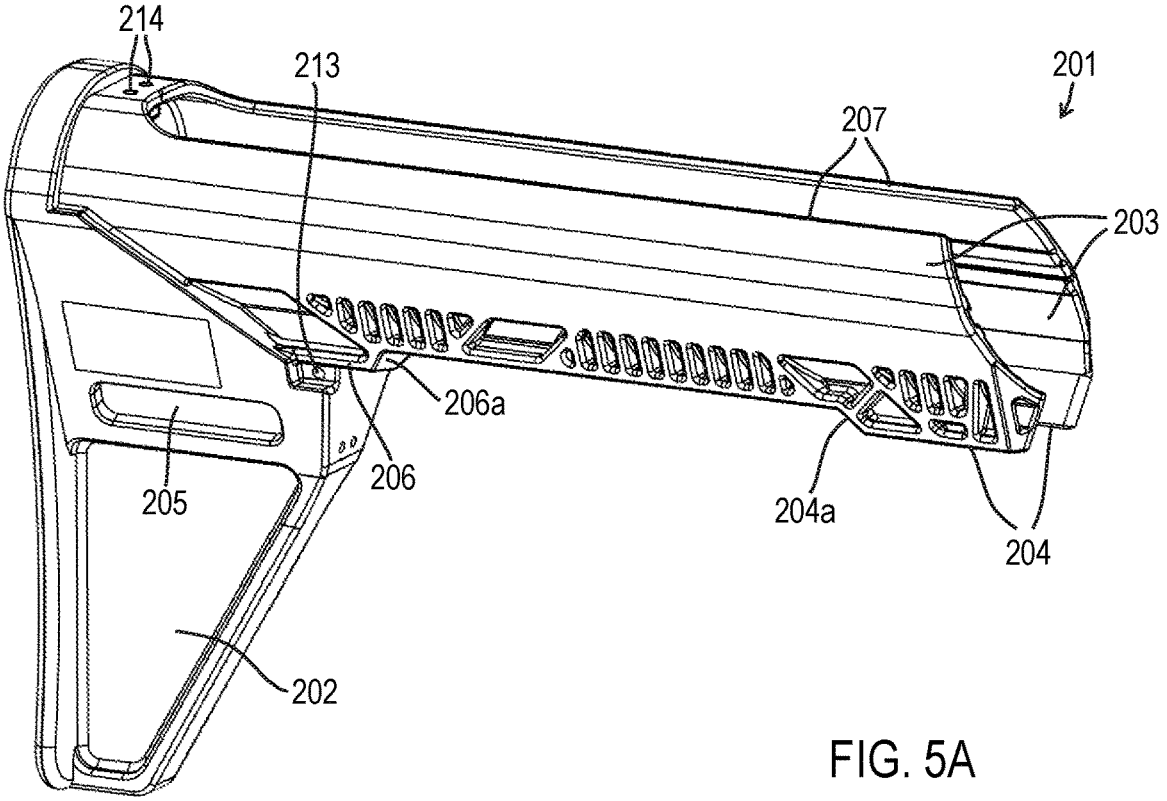
FIG. 5A is a front perspective view of the stock insert of the buffer tube cover assembly of FIG. 1A.
Figure 5B:
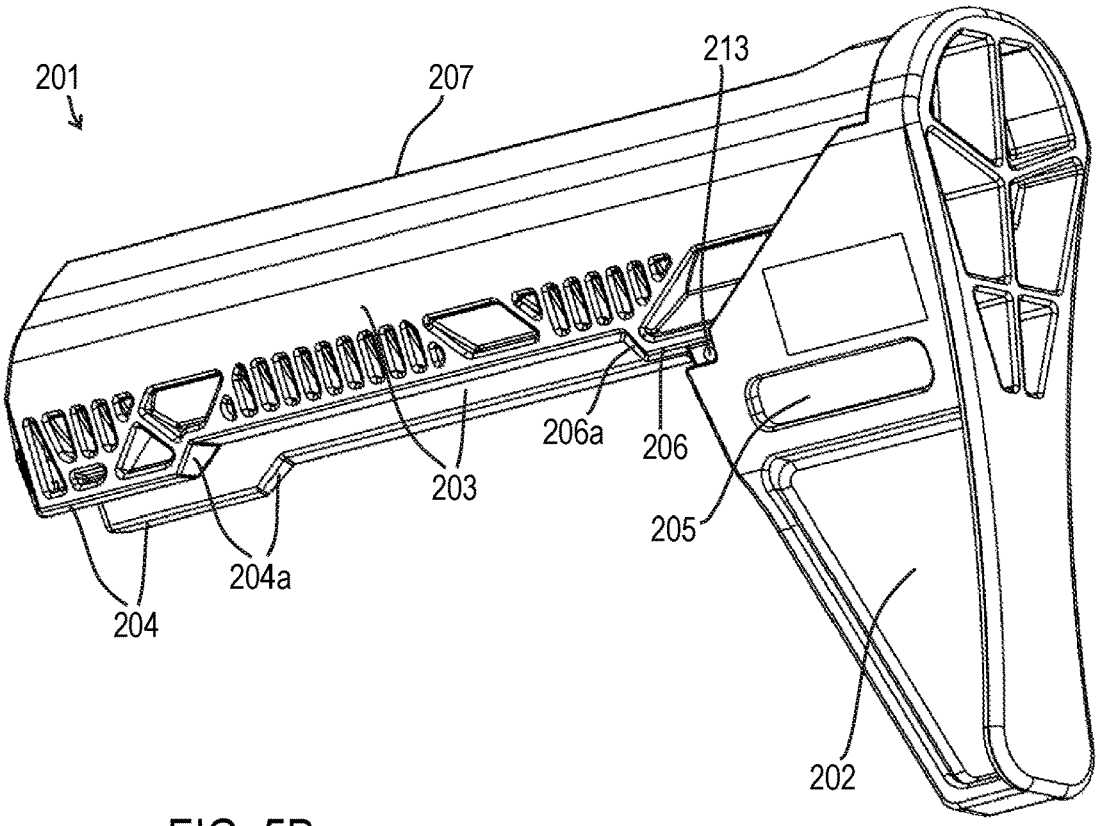
FIG. 5B is a rear perspective view of the stock insert of FIG. 5A.
Figure 5C:
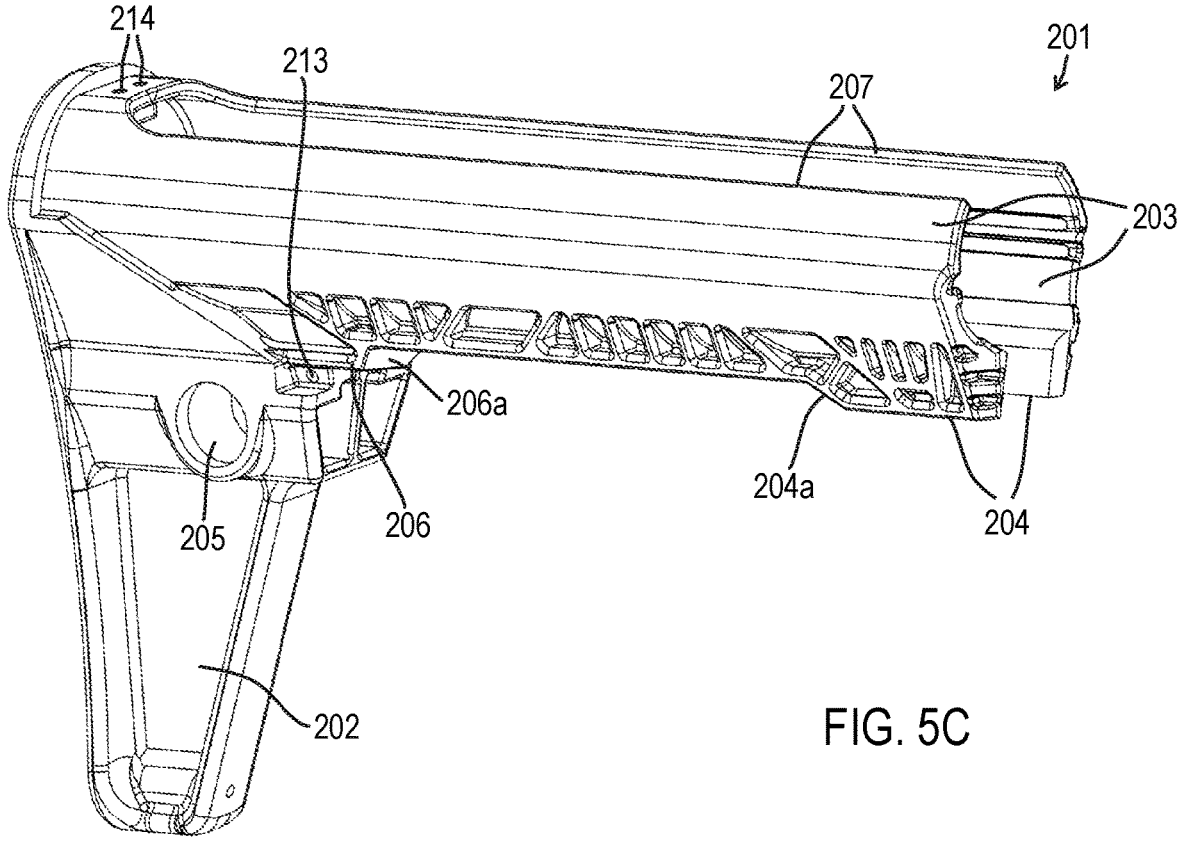
FIG. 5C is a front perspective view of a stock insert of the buffer tube cover assembly of FIG. 1A.
Figure 5D:
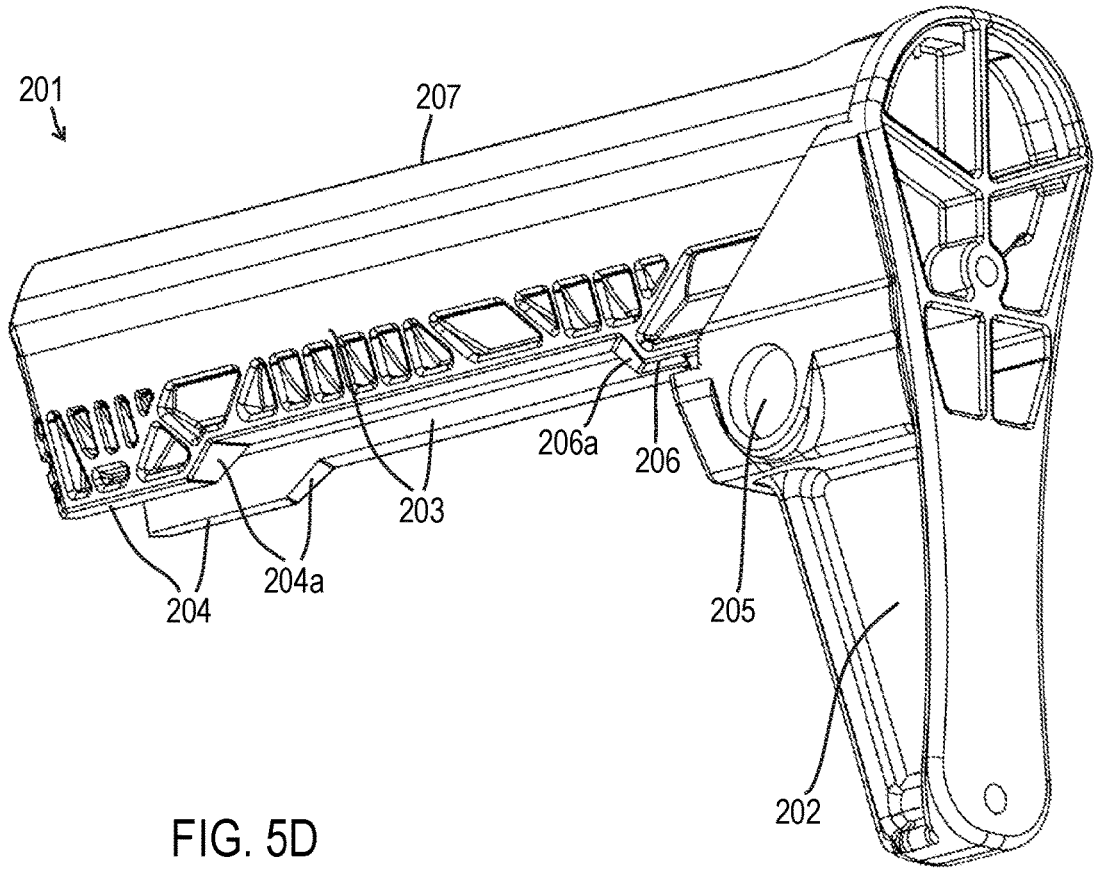
FIG. 5D is a rear perspective view of the stock insert of FIG. 5C.
Figure 6A:
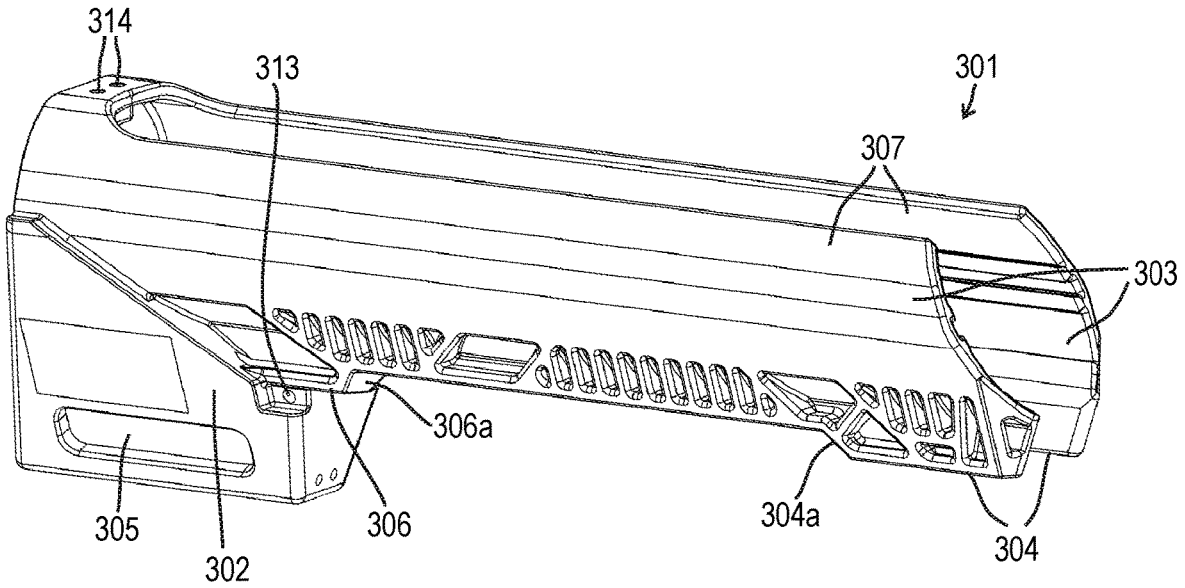
FIG. 6A is a front perspective view of the featureless insert of the buffer tube cover assembly of FIG. 2A.
Figure 6B:
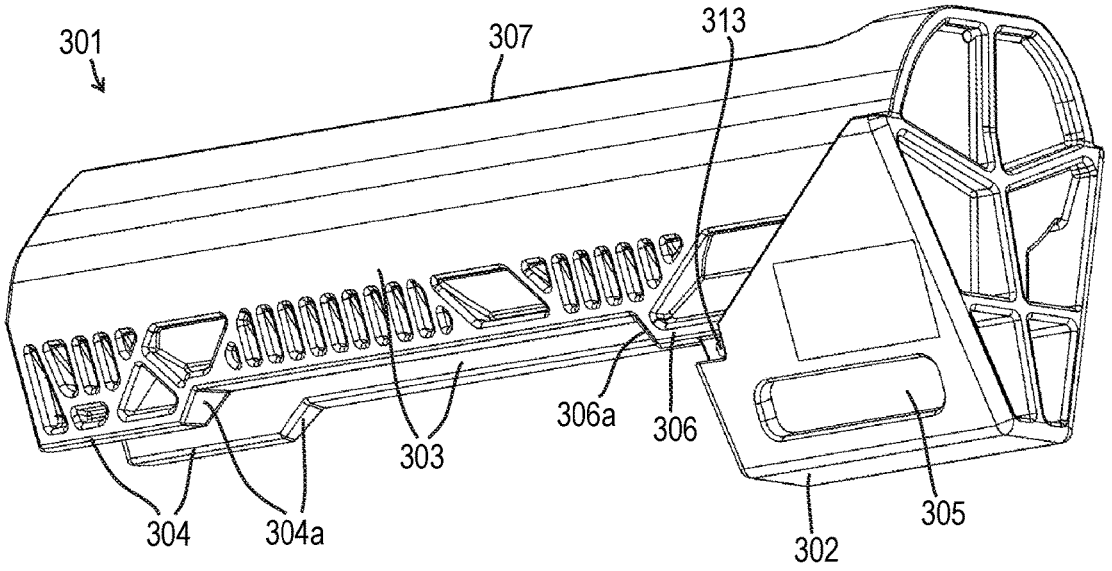
FIG. 6B is a rear perspective view of the featureless insert of FIG. 6A.
Figure 6C:
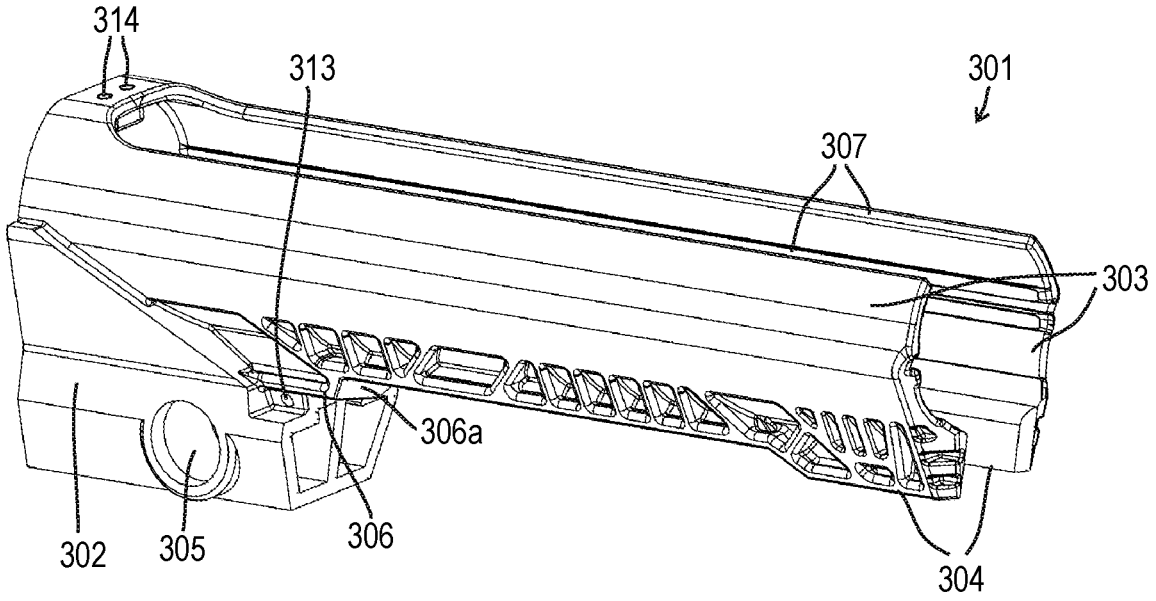
FIG. 6C is a front perspective view of a featureless insert of the buffer tube cover assembly of FIG. 2A.
Figure 6D:
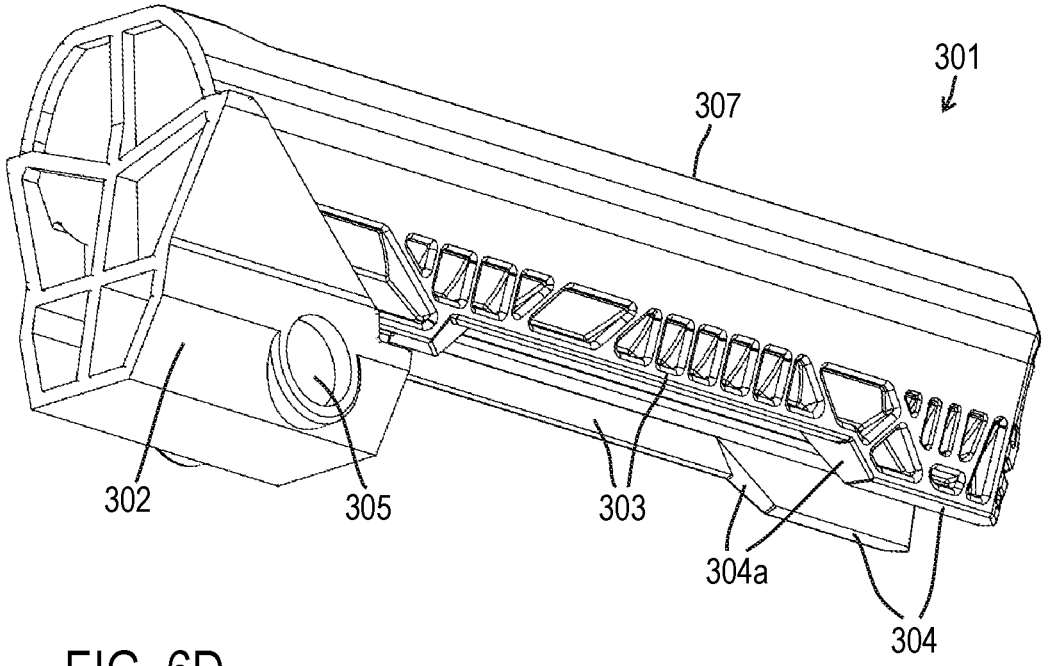
FIG. 6D is a rear perspective view of the featureless insert of FIG. 6C.
Figure 7A:
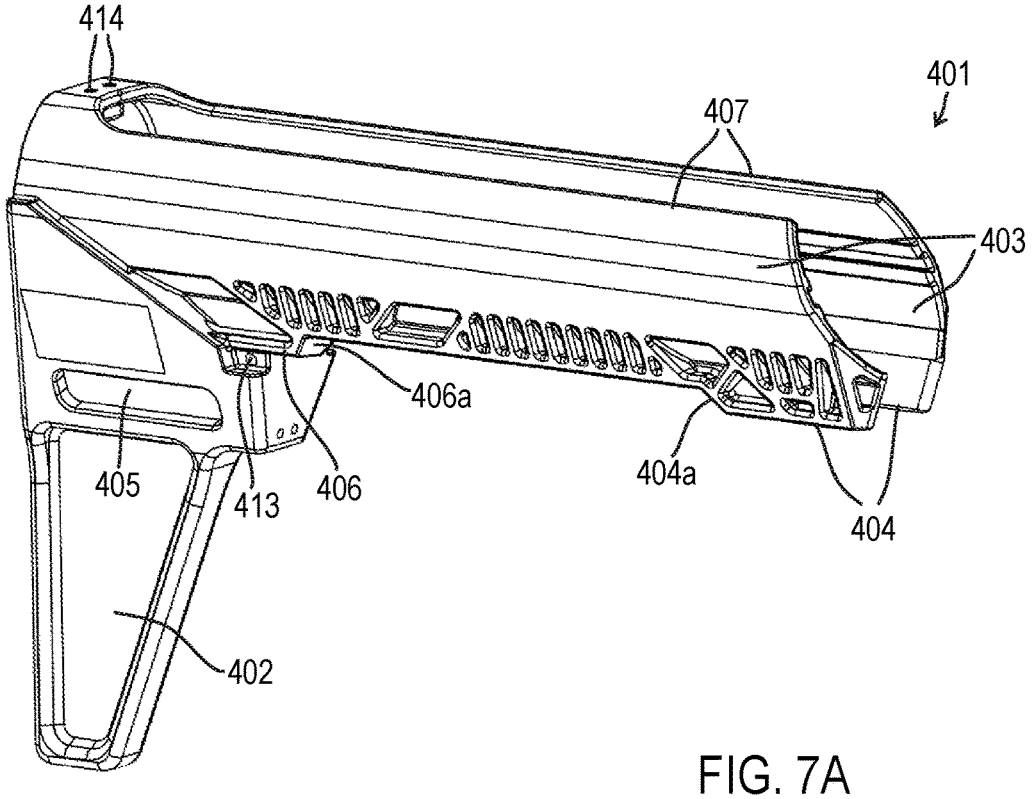
FIG. 7A is a front perspective view of the arm brace insert of the buffer tube cover assembly of FIG. 3A.
Figure 7B:
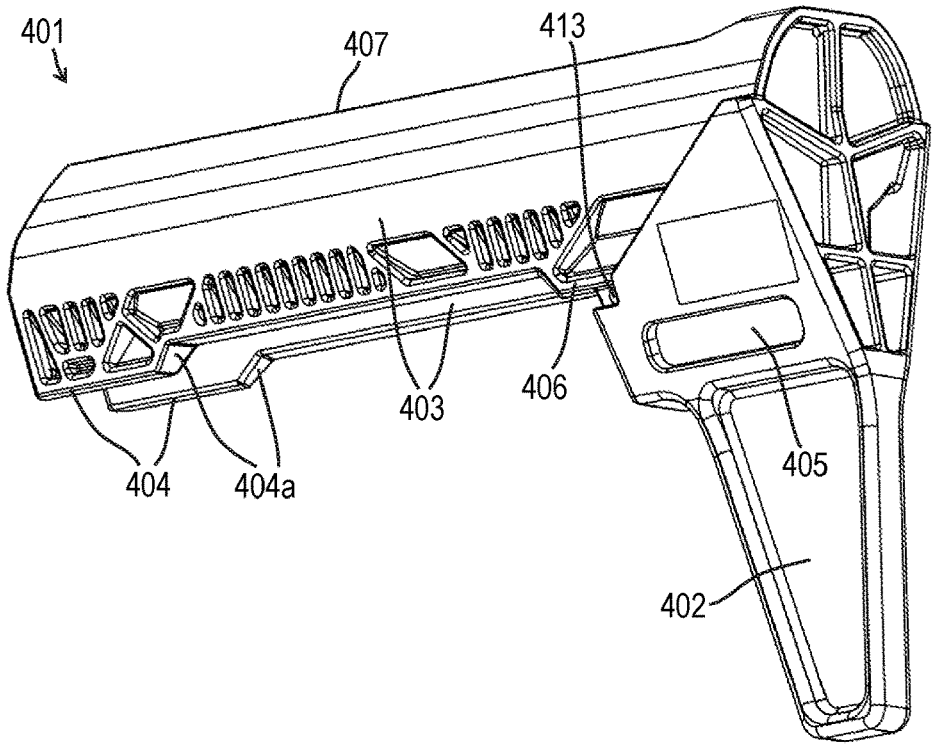
FIG. 7B is a rear perspective view of the arm brace insert of FIG. 7A.
Figure 8:
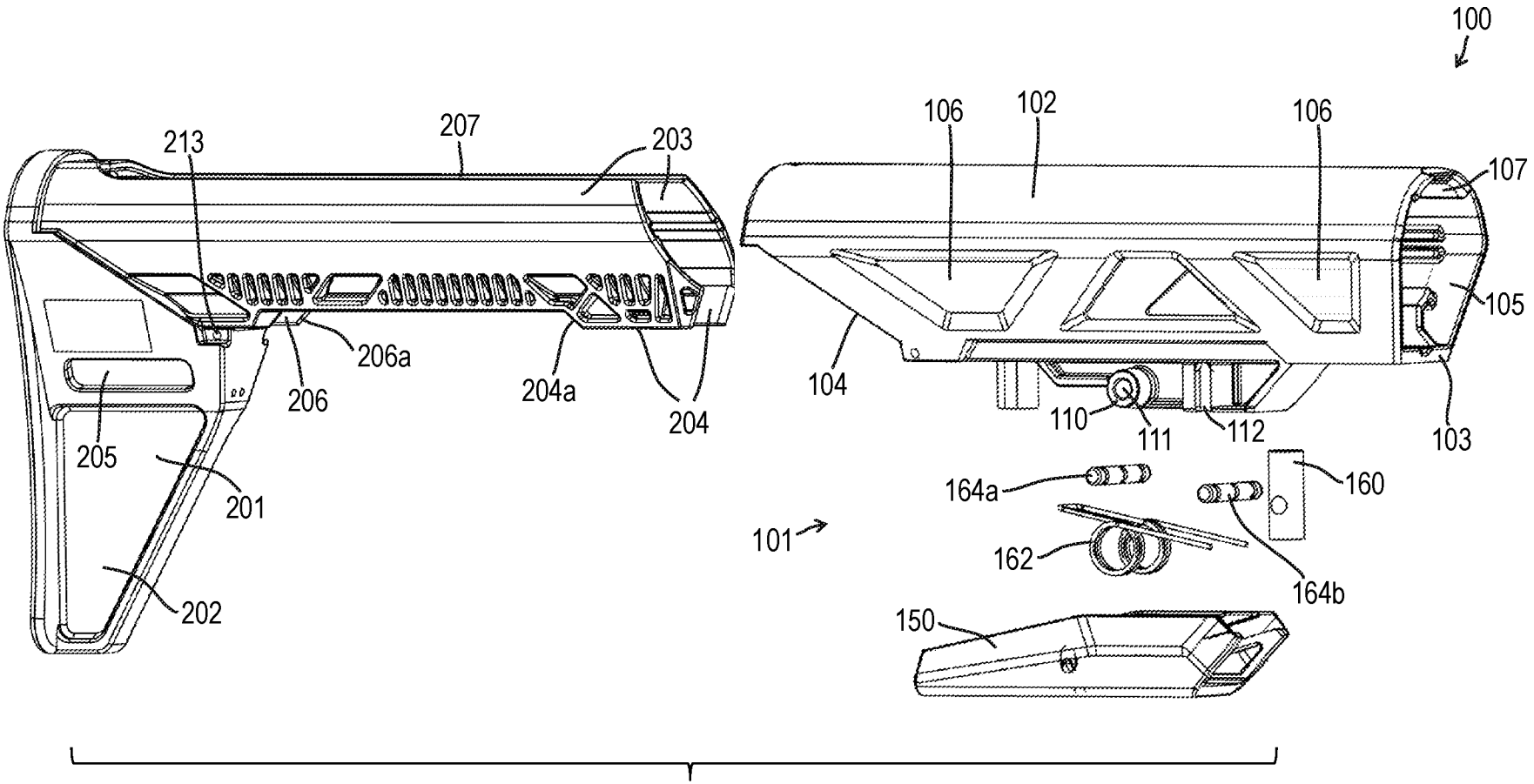
FIG. 8 is an exploded perspective view of the buffer tube cover assembly of FIG. 1A.

As shown in FIGS. 4D and 8, the spring 162 of the cover base assembly 101 may include a coil portion that wraps around and/or is concentric with the cylindrical member 110 of the cover tube 102. The purpose of the spring 162 is to bias the lever 150 into the engaged configuration (as shown in the drawings). In the engaged configuration, the forward end 151 is biased upward such that the second pin 164*b* is pushed upward causing the buffer locating portion 160 to move upward to engage a hole within the protrusion 21 of the buffer tube 20. In some cases, the protrusion 21 includes a series of holes along its length such that the location of the cover base assembly 101 can change relative to the buffer tube 20. In such a configuration, the user may press the aft end 153 causing the lever 150 to pivot about the first pin 164*a* such that the buffer locating portion 160 moves downward (disengaging from any features in protrusion 21) which allows the user to move the buffer tube cover assembly 100 along the length of the buffer tube 20.

Embodiments of the stock insert 201 are shown in FIGS. 1A, 1B, 5A-5D, and 8-9C. The stock insert 201 may include a rear portion 202 configured to interface with a user's shoulder, at least one forward protruding member 203, at least one forward locating portion 204, at least one external attachment member 205, at least one aft locating portion 206, and at least one locking interface 213, 214. As shown in the drawings, each forward protruding member 203 may include an upper edge 207. The at least one external attachment member 205 may be a quick disconnect (see FIGS. 5C and 5D) and/or a rail interface attachment including, for example, a modular lock (see FIGS. 5A and 5B), a key shaped modular rail system, a Picatinny rail (MIL-STD-1913 rail or STANAG 2324 rail), a Weaver rail, or any other appropriate rail.

FIGS. 2A, 2B, 6A-6D, 10A, 10B, 12A, and 12B show embodiments of the featureless insert 301. The featureless insert 301 may include a rear portion 302, at least one forward protruding member 303, at least one forward locating portion 304, at least one external attachment member 305, at least one aft locating portion 306, and at least one locking interface 313, 314. As shown in the drawings, each forward protruding member 303 may include an upper edge 307. The at least one external attachment member 305 may be a quick disconnect (see FIGS. 6C and 6D) and/or a rail interface attachment including, for example, a modular lock (see FIGS. 6A and 6B), a key shaped modular rail system, a Picatinny rail (MIL-STD-1913 rail or STANAG 2324 rail), a Weaver rail, or any other appropriate rail.

Embodiments of the arm brace insert 401 are shown in FIGS. 3A, 3B, 7A, and 7B. The arm brace insert 401 may include a rear portion 402 configured to interface with a user's arm or forearm, at least one forward protruding member 403, at least one forward locating portion 404, at least one external attachment member 405, at least one aft locating portion 406, and at least one locking interface 413, 414. In some embodiments, the rear portion 402 includes a contoured shape (e.g., concave) designed to interface with a user's arm. In addition, the arm brace insert 401 may include a strap or provisions for a strap that secures the arm brace insert 401 to a user's body (e.g., to the forearm). As shown in the drawings, each forward protruding member 403 may include an upper edge 407. The at least one external attachment member 405 may be a quick disconnect and/or a rail interface attachment including, for example, a modular lock (see FIGS. 7A and 7B), a key shaped modular rail system, a Picatinny rail (MIL-STD-1913 rail or STANAG 2324 rail), a Weaver rail, or any other appropriate rail.

In some embodiments, the cover base assembly 101 is designed to attach to at least one of the stock insert 201, the featureless insert 301, and/or the arm brace insert 401. These inserts 201, 301, 401 may include installed configurations, which are illustrated in FIGS. 1A-3B. The inserts 201, 301, 401 may also include uninstalled or partially installed configurations (see FIGS. 8-9C for some examples). As shown in FIGS. 4A-4D and 8-9B, at least a portion of the insert may fit within the internal cavity 105 of the cover tube 102 such that part of the insert passes through the aft end 104. In some embodiments, the at least one inner protrusion 107 of the cover tube 102 may function to locate and/or guide the insert into the appropriate position. For example, the cover tube 102 may include two inner protrusions 107 where the outer edge of each protrusion 107 is designed to engage and interface with the appropriate upper edge 207, 307, 407 of the corresponding forward protruding member 203, 303, 403. These interfaces prevent the relevant insert 201, 301, 401 from rotating relative to the cover base assembly 101 and guide the insert through the internal cavity 105 (e.g., see FIGS. 9A-9C). For example, the interface between the protrusions 107 and the upper edges 207 of the stock insert 201 ensure that the rear portion 202 remains aligned vertically to facilitate ergonomic engagement with a user. Similarly, the interface between the protrusions 107 and the upper edges 407 of the arm brace insert 401 ensure that the rear portion 402 remains aligned vertically to facilitate ergonomic engagement with a user.

The at least one positioning member 108 of the cover tube 102 (see FIG. 4C) may engage with one or both of the at least one forward locating portion 204, 304, 404 and/or the at least one aft locating portion 206, 306, 406 of one of the inserts. The cover tube 102 may include two positioning members 108 that are symmetric on each side of the cover tube 102. In some embodiments, in the installed configuration, the forward locating portion(s) 204, 304, 404 are disposed on a forward side of the appropriate positioning member 108 and the aft locating portion(s) 206, 306, 406 are disposed on a rear side of the appropriate positioning member 108. For example, in some cases when the stock insert 201 is in the installed configuration, a rear surface 204*a* of the forward locating portion 204 is adjacent to and/or in contact with a forward surface 108*a* of the positioning member 108. Similarly, when the featureless insert 301 is in the installed configuration, a rear surface 304*a* of the forward locating portion 304 may be adjacent to and/or in contact with the forward surface 108*a* of the positioning member 108. Similarly, when the arm brace insert 401 is in the installed configuration, a rear surface 404*a* of the forward locating portion 404 may be adjacent to and/or in contact with the forward surface 108*a* of the positioning member 108. In addition, in some cases when the stock insert 201 is in the installed configuration, a forward surface 206*a* of the aft locating portion 206 is adjacent to and/or in contact with an aft surface 108*b* of the positioning member 108. Similarly, when the featureless insert 301 is in the installed configuration, a forward surface 306*a* of the aft locating portion 306 may be adjacent to and/or in contact with the aft surface 108*b* of the positioning member 108. Similarly, when the arm brace insert 401 is in the installed configuration, a forward surface 406*a* of the aft locating portion 406 may be adjacent to and/or in contact with the forward surface 108*a* of the positioning member 108.

In some embodiments, attachment or removal of the stock insert 201, featureless insert 301, and/or arm brace insert 401 includes a temporary deflection or deformation of one or both of the forward protruding member(s) 203, 303, 403. As described above, the appropriate insert 201, 301, 401 enters the internal cavity 105 at the aft end 104 and the outer edge of each protrusion 107 is designed to engage and interface with the appropriate upper edge 207, 307, 407 of the corresponding forward protruding member 203, 303, 403. As the insert 201, 301, 401 moves forward toward the forward end 103, the forward locating portion(s) 204, 304, 404 will contact the aft surface 108*b* of the positioning member 108. Based on the shape of the forward locating portion(s) 204, 304, 404 and/or the aft surface 108*b*, the forward protruding member(s) 203, 303, 403 will deflect inward toward the center of the internal cavity 105. In particular, the lower portion of the forward protruding member(s) 203, 303, 403 (at the forward locating portion(s) 204, 304, 404) deflect inward to slide past the positioning member 108. The upper edge(s) 207, 307, 407 remain constrained by the protrusion(s) 107 of the cover tube 102. In other words, the deflection is primarily located at the bottom of the forward protruding member(s) 203, 303, 403. The interaction with the protrusion(s) 107 of the cover tube 102 continues to prevent rotation of the insert during installation and removal of the insert.

Figure 9A:
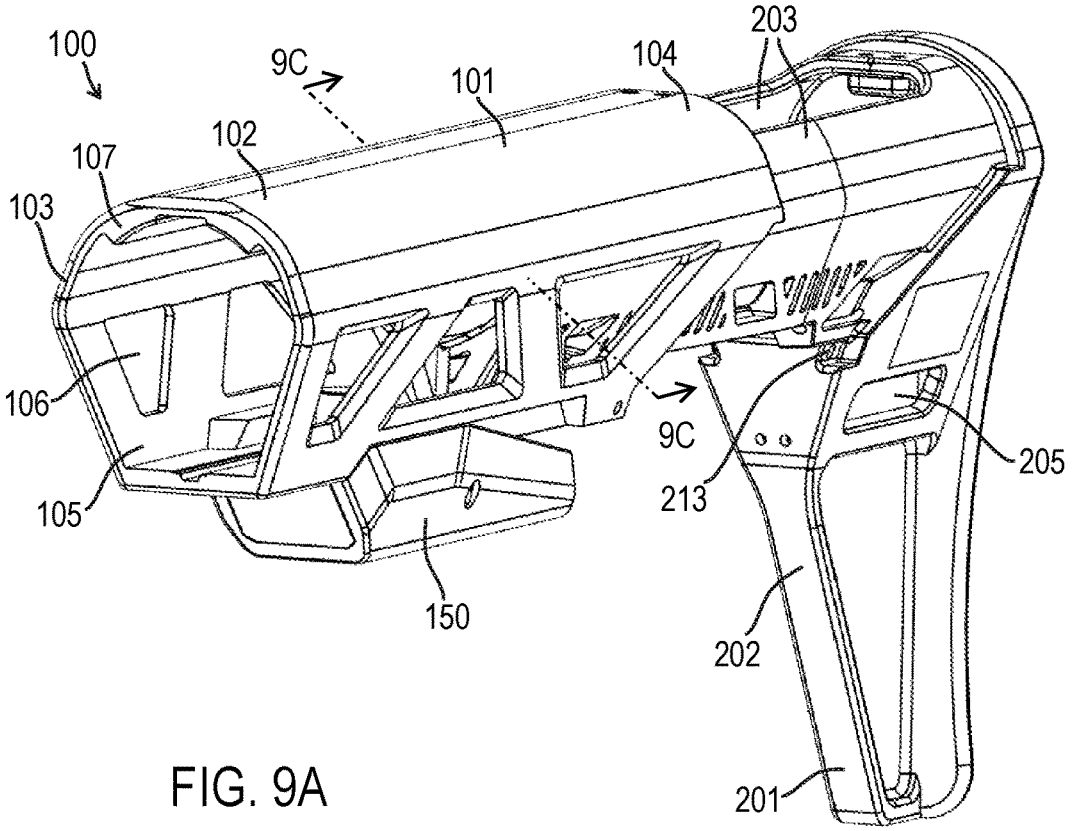
FIG. 9A is a front perspective view of a buffer tube cover assembly with a stock insert partially inserted according to certain embodiments of the present invention.
Figure 9B:
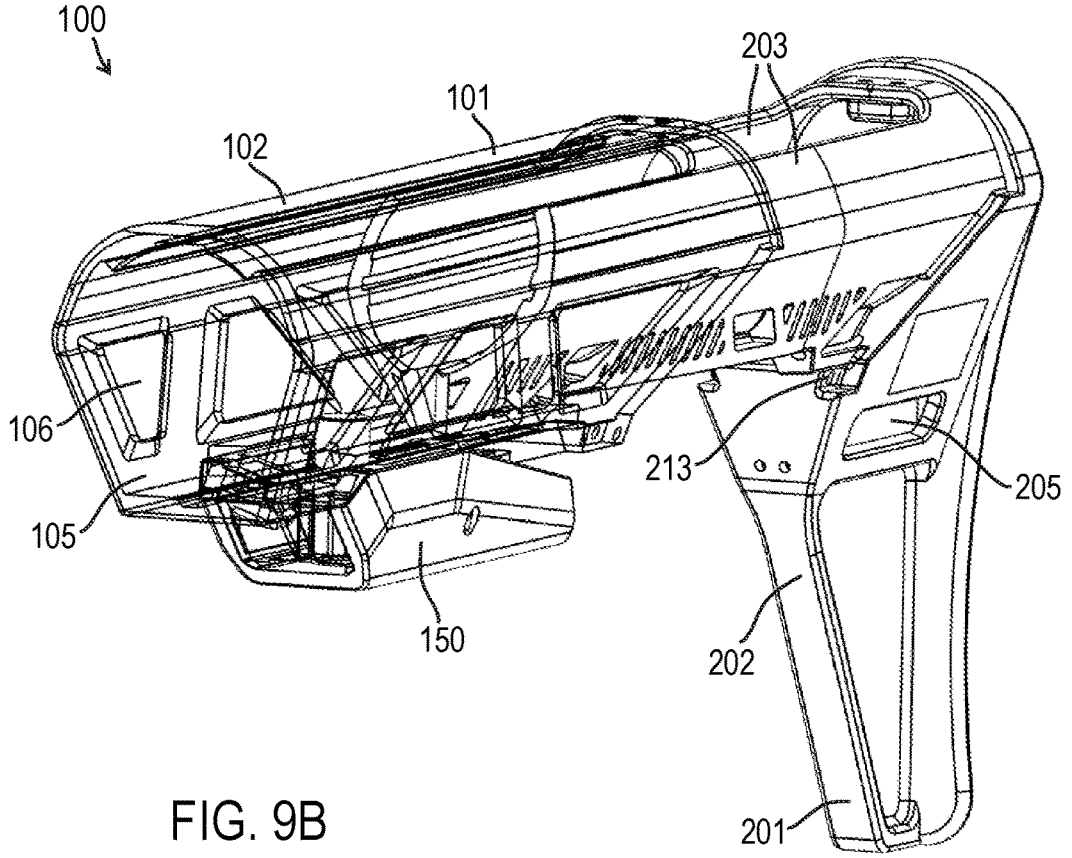
FIG. 9B is a front perspective view of the buffer tube cover assembly of FIG. 9A.
Figure 9C:
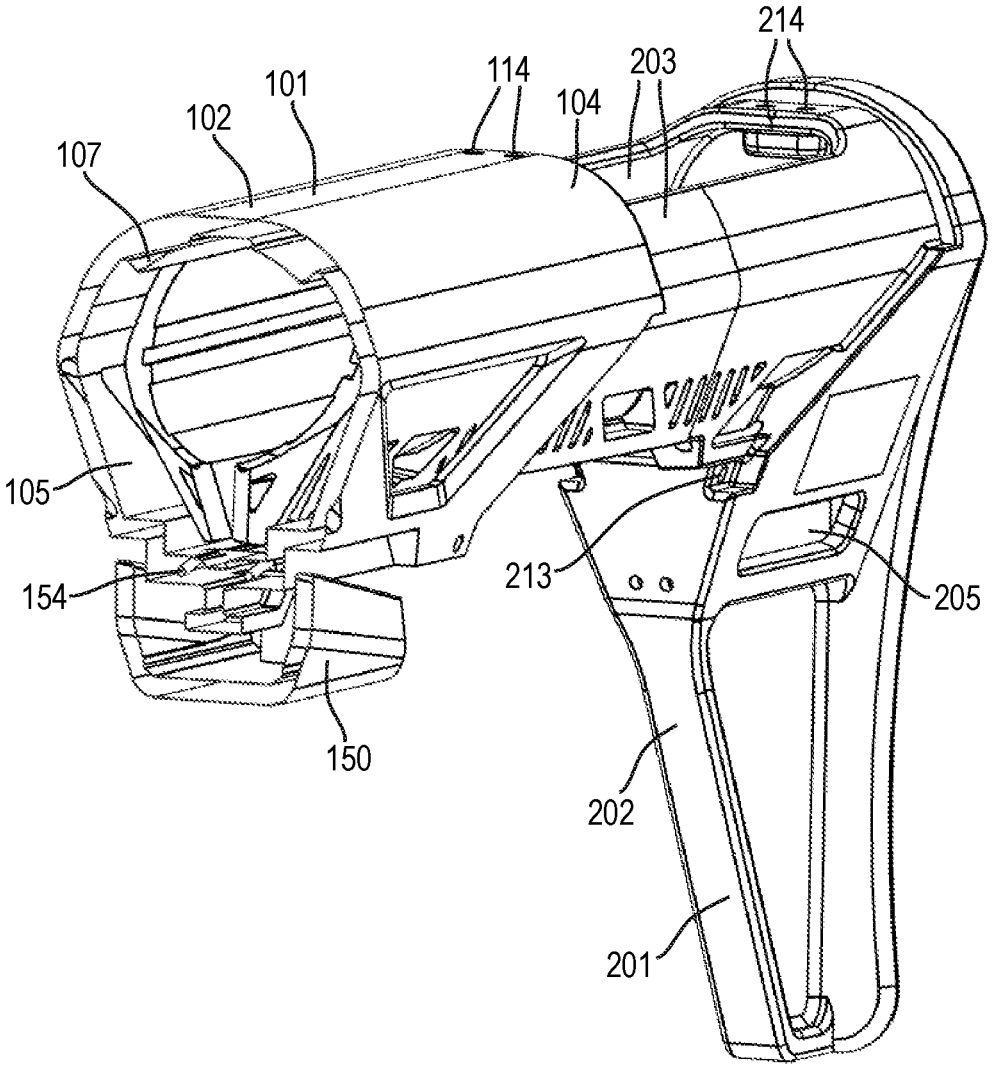
FIG. 9C is a cross-section view of the buffer tube cover assembly of FIG. 9A.
Figure 10A:
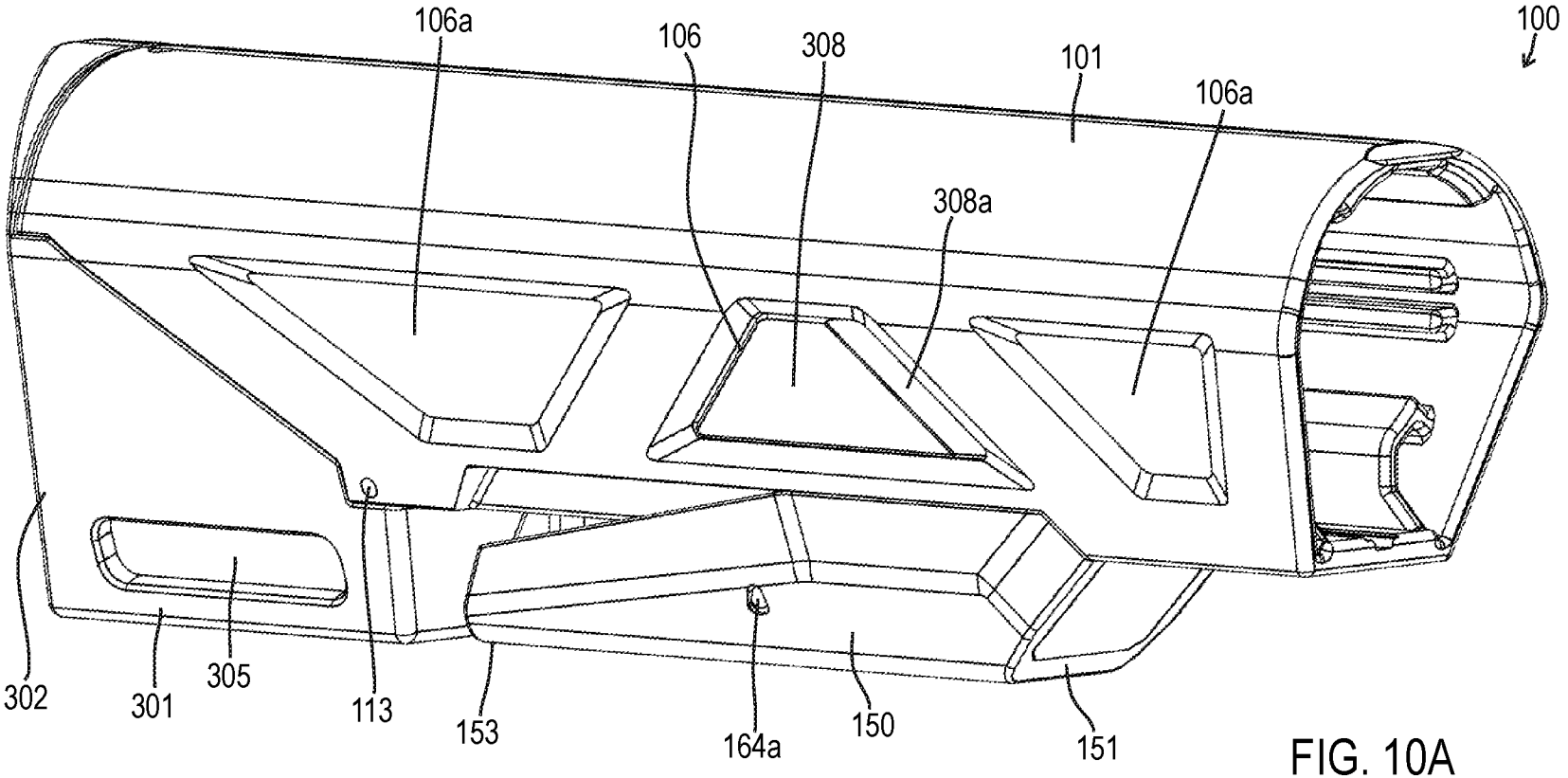
FIG. 10A is a front perspective view of a buffer tube cover assembly with a featureless insert according to certain embodiments of the present invention.
Figure 10B:
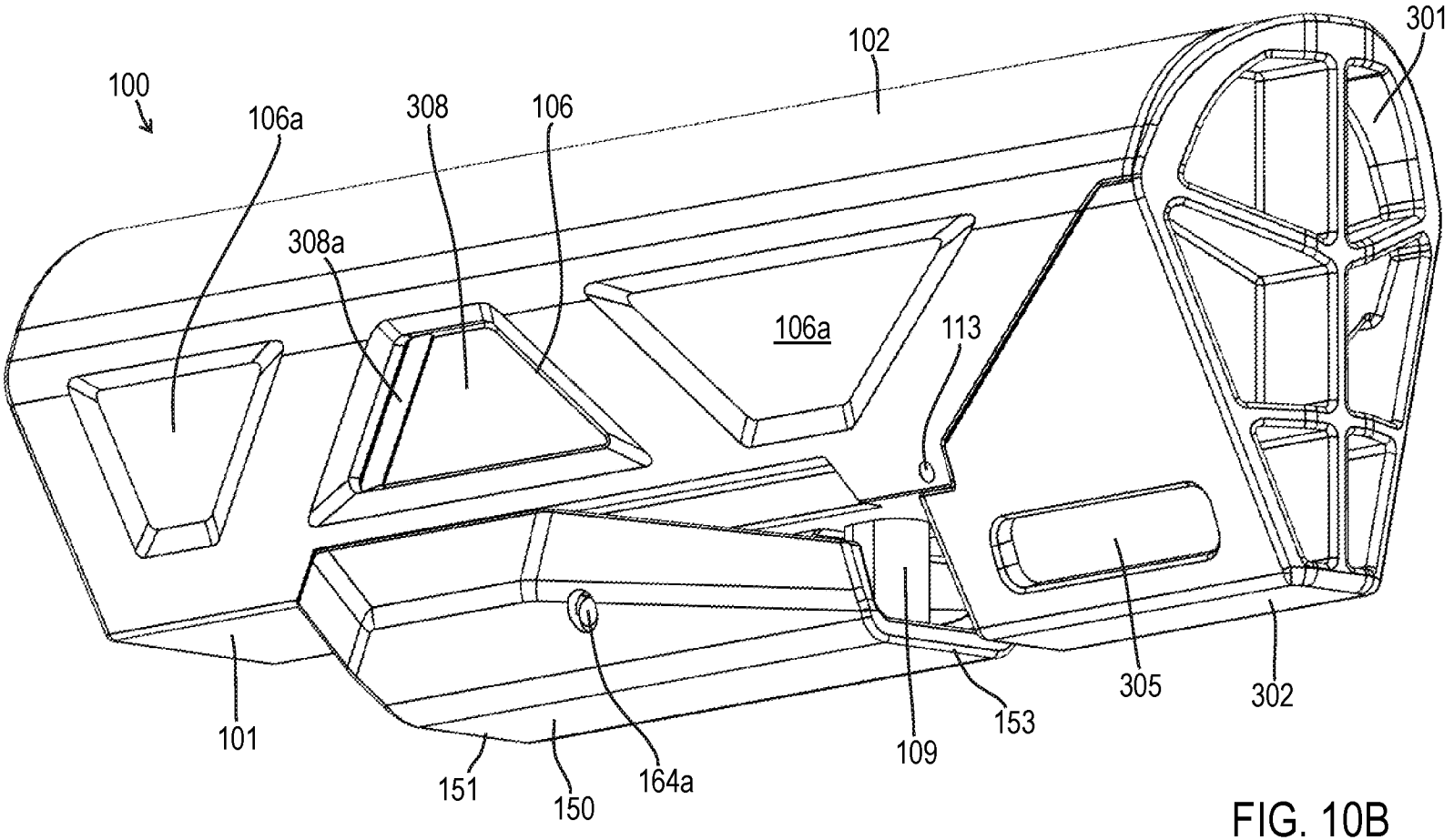
FIG. 10B is a rear perspective view of the buffer tube cover assembly of FIG. 10A.
Figure 11A:
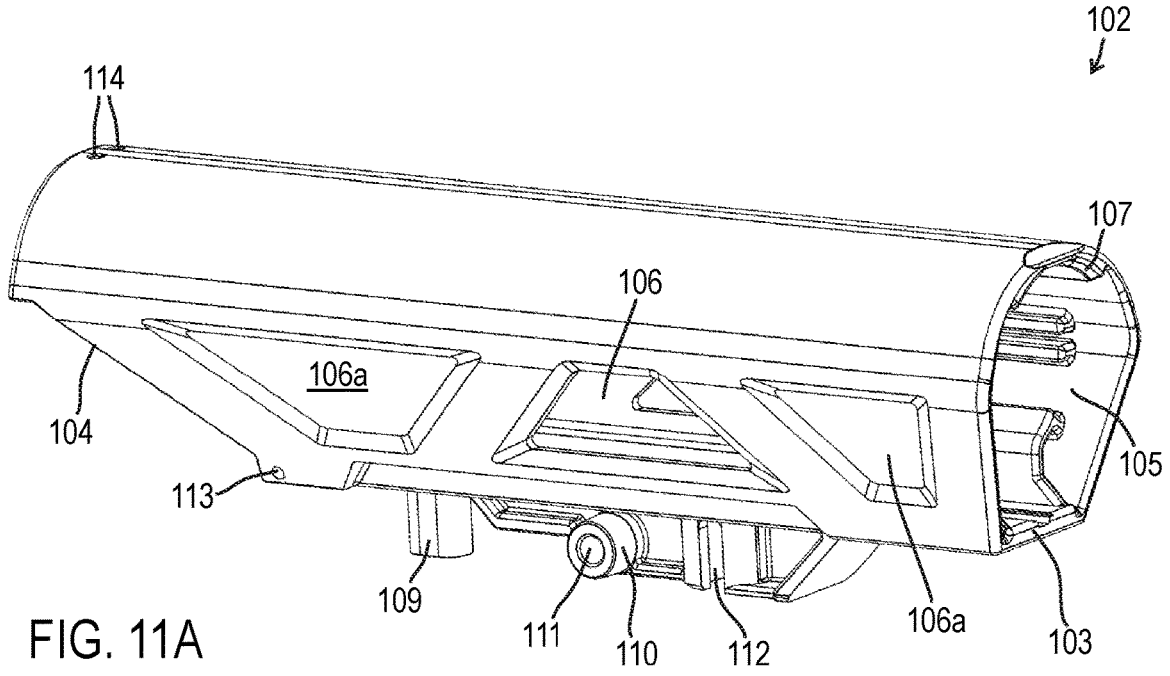
FIG. 11A is a front perspective view of a cover tube of the buffer tube cover assembly of FIG. 10A.
Figure 11B:
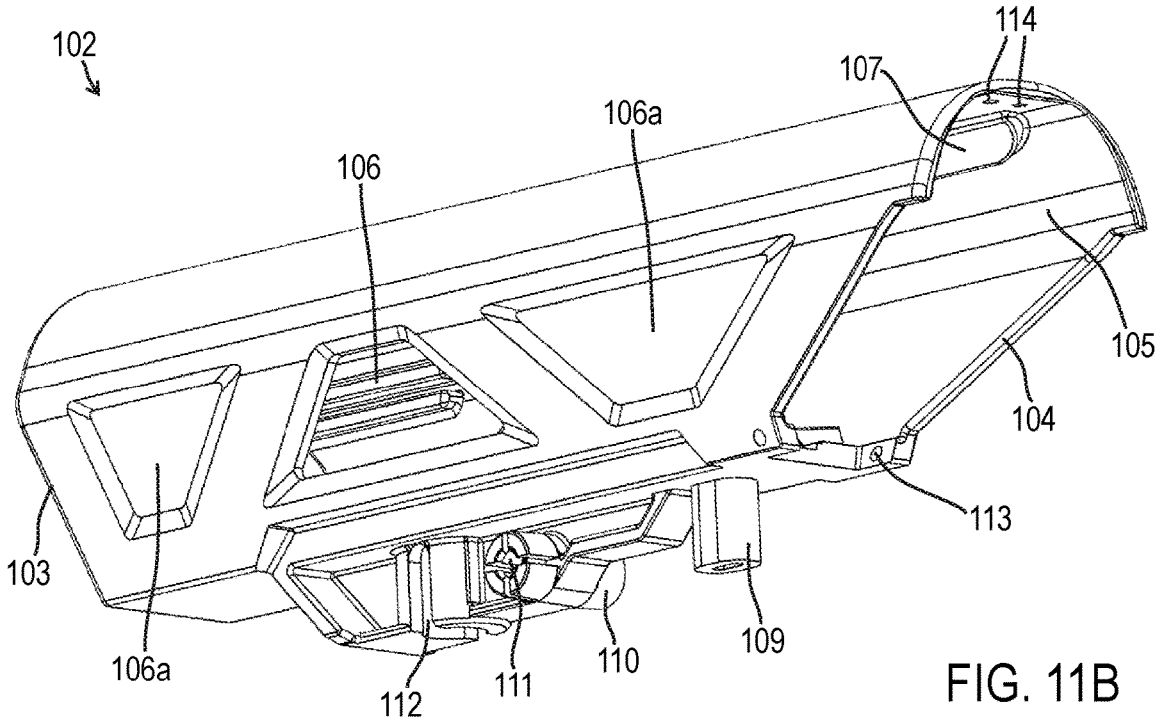
FIG. 11B is a rear perspective view of the cover tube of FIG. 11A.
Figure 12A:
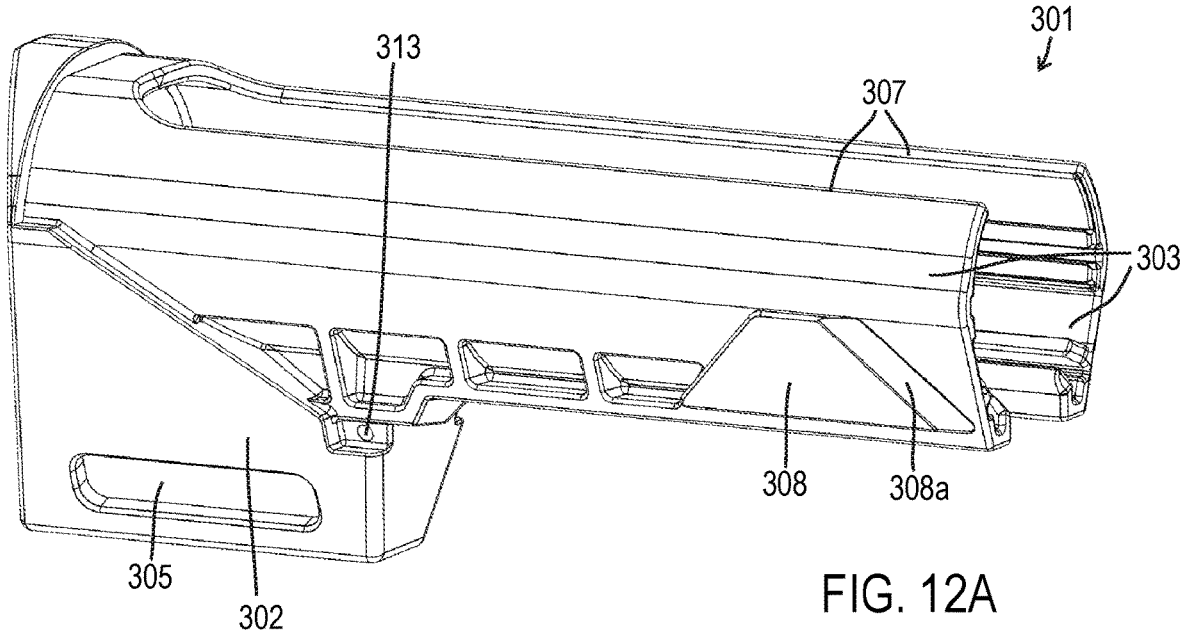
FIG. 12A is a front perspective view of the featureless insert of the buffer tube cover assembly of FIG. 10A.
Figure 12B:
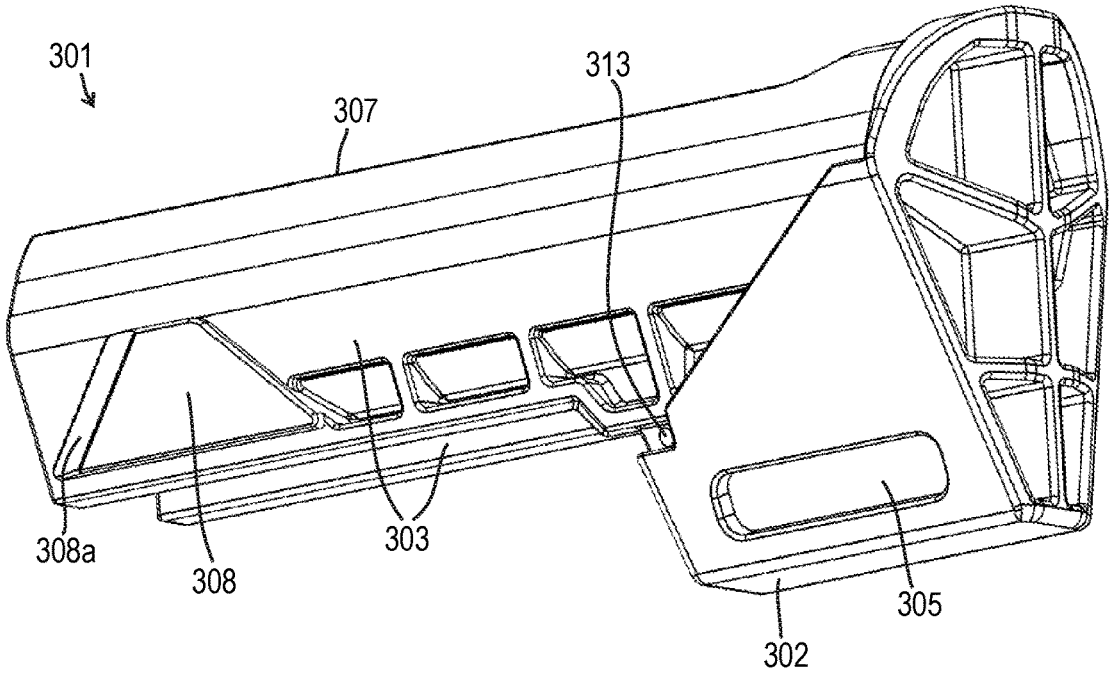
FIG. 12B is a rear perspective view of the featureless insert of FIG. 12A.

The deflected configuration is shown in FIGS. 9B and 9C. The forward protruding member(s) 203, 303, 403 remain in the deflected configuration as the insert 201, 301, 401 moves forward until the rear surface 304*a* of the forward locating portion(s) 204, 304, 404 reaches the forward surface 108*a* of the positioning member 108. Based on the shape of the forward locating portion(s) 204, 304, 404 and/or the forward surface 108*a*, the forward protruding member(s) 203, 303, 403 move back outward back to the typical configuration such that the outer surfaces of the forward protruding member(s) 203, 303, 403 are approximately parallel and/or in contact with the inner surfaces of the internal cavity 105. In some embodiments, the buffer locating portion 160 will need to move downward to provide sufficient space for the forward locating portion(s) 204, 304, 404 to move through the relevant portion of the cover base assembly 101. It may be necessary to take the buffer tube cover assembly 100 off of the buffer tube to remove the insert 201, 301, 401. Removal of the insert 201, 301, 401 is a similar process as described above but in reverse. For example, to begin removal, pulling the insert 201, 301, 401 rearward relative to the cover base assembly 101 will cause the forward protruding member(s) 203, 303, 403 (at the forward locating portion(s) 204, 304, 404) deflect inward (based on interacting with the forward surface 108*a* of the positioning member 108). In some embodiments, the user may push inward on the forward protruding member(s) 203, 303, 403 through the opening(s) 106 to facilitate this process.

The cover base assembly 101 may include an optional lever motion stop member 109 (see FIGS. 1B-4E). There are some jurisdictions within the United States that include onerous restrictions on firearm use. For example, some jurisdictions dictate that features such as a stock attached to a buffer tube cannot be adjustable. The lever motion stop member 109 may be a separate component from the cover tube 102 or may be an integral component of the cover tube 102. If separate, lever motion stop member 109 may be attached with a fastener, a dovetail or other mechanical connection, adhesive or other chemical fastening, and/or any other relevant connection. If integral, the lever motion stop member 109 may be a machined metallic feature of the cover tube 102 or may be feature of the cover tube 102 created during an injection molding process. During production of the cover tube 102, the lever motion stop member 109 may be omitted during the machining process, may be eliminated by changing/closing the appropriate gate/valve/insert in a mold, may be cut off after being created, and/or may be eliminated in any other relevant way. The presence of the lever motion stop member 109 restricts and/or prevents motion of the lever 150. For example, the lever motion stop member 109 may prevent the lever 150 from rotating about the first pin 164*a*. When present, the lever motion stop member 109 causes the cover base assembly 101 (and/or the buffer tube cover assembly 100) to be non-adjustable. In other words, a user would not be able to move the buffer tube cover assembly 100 relative to the buffer tube 20.

In some embodiments, the cover base assembly 101 includes at least one locking interface 113, 114. The locking interface 113, 114 may be a hole, a spine, a notch, a step, a dovetail, and/or any other relevant feature. The locking interface 113, 114 may correspond to a feature of one or more of the inserts (e.g., stock insert 201, featureless insert 301, and/or arm brace insert 401) that may attach to the cover base assembly 101. For example, the stock insert 201 may include the locking interface 213 that corresponds to locking interface 113 and the locking interface 214 that corresponds to locking interface 114. Similarly, the featureless insert 301 may include the locking interface 313 that corresponds to locking interface 113 and the locking interface 314 that corresponds to locking interface 114. Similarly, the arm brace insert 401 may include the locking interface 413 that corresponds to locking interface 113 and the locking interface 414 that corresponds to locking interface 114. In some embodiments, the locking interfaces are holes that align with the corresponding hole(s) when the insert is in the installed configuration. The locking interfaces may be used to permanently fix an insert onto the cover base assembly 101. For example, the stock insert 201 may be permanently attached to the cover base assembly 101 by inserting a pin into the locking interface 213, locking interface 113 and/or inserting a pin into the locking interface 214, locking interface 114. Similarly, the featureless insert 301 may be permanently attached to the cover base assembly 101 by inserting a pin into the locking interface 313, locking interface 113 and/or inserting a pin into the locking interface 314, locking interface 114. Similarly, the arm brace insert 401 may be permanently attached to the cover base assembly 101 by inserting a pin into the locking interface 413, locking interface 113 and/or inserting a pin into the locking interface 414, locking interface 114. In some embodiments, the locking interfaces 113, 114, 213, 214, 313, 314, 413, 414 are only utilized when the buffer tube cover assembly 100 is being sold/shipped to a user in a jurisdiction with restrictive rules or law related to the configuration of firearms, shoulder stocks, arm braces, or other relevant components.

As shown in FIGS. 10A-12B, some embodiments of the buffer tube cover assembly 100 include an alternative mechanical system for securing the insert relative to the cover base assembly 101. This mechanical system may be in addition to or in lieu of the engagement of the forward locating portion(s) 304. The featureless insert 301 may include at least one protrusion 308 designed to interface with a corresponding opening 106 of the cover tube 102 when the featureless insert 301 is in the installed configuration (e.g., see FIGS. 10A and 10B). In some embodiments, the cover tube 102 of the cover base assembly 101 includes at least one recess 106*a* that does not extend through the full thickness of the cover tube 102. The recess(es) 106*a* may be similar to blind holes that function to reduce material for manufacturing purposes, weight, aesthetic reasons, and/or any other appropriate purposes. The at least one opening 106 (and/or recess 106*a*) may be shaped as a polygon and/or as any other appropriate shape. For example, the at least one opening 106 may be shaped as a rectangle, a trapezoid, a rhombus, an isosceles trapezoid, a parallelogram, a triangle, a pentagon, a hexagon, a circle, a decagon, and/or any other appropriate shape. The corresponding protrusion(s) 308 may include a matching shape to the appropriate opening 106. Each protrusion 308 may include at least one angled or beveled surface 308*a* that helps during installation of the insert 301. For example, the beveled surface(s) 308*a* may cause each forward protruding member 303 to deflect inward when the insert 301 is inserted into the aft end 104 of the cover base assembly 101. During installation as the insert 301 slides forward relative to the cover tube 102, the forward protruding member(s) 303 would remain deflected inward until the protrusion 308 reaches the appropriate opening 106 of the cover tube 102 when the protrusion 308 will protrude through the opening and the forward protruding member(s) 303 will move back outward to the typical shape. To remove the insert 301, the user may press the protrusion(s) 308 inward (similar to a button) to allow the insert 301 to more rearward relative to the cover tube 102. Although the drawings only show the mechanical arrangement with the opening 106 and corresponding protrusion (i.e., protrusion 308) for the featureless insert 301, this mechanical arrangement can be included with the stock insert 201, the arm brace insert 401, and/or any other appropriate insert.

The components of any of the components described herein may be formed of materials including, but not limited to, thermoplastic, carbon composite, plastic, nylon, polyethylene, polyetherimide, polypropylene, polyvinyl chloride, steel, aluminum, stainless steel, high strength aluminum alloy, other plastic or polymer materials, other metallic materials, other composite materials, or other similar materials. Moreover, the components of the devices described herein may be attached to one another via suitable fasteners, which include, but are not limited to, screws, bolts, rivets, welds, over-molding, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A buffer tube cover assembly comprising:
a cover base assembly; and
an insert attached to a rear side of the cover base assembly, wherein:
the cover base assembly comprises a cover tube, a lever, a buffer locating portion, a spring, and at least one pin;
the insert comprises at least one forward protruding member disposed inside the cover base assembly;
the at least one forward protruding member extends more than half of a total length of the buffer tube cover assembly from rear to front; and
the at least one forward protruding member comprises an at least partially cylindrical shape and is disposed in an upper portion of the cover base assembly adjacent to an interface with a buffer tube.

2. The buffer tube cover assembly of claim 1, wherein the insert is modular and removable.

3. The buffer tube cover assembly of claim 1, wherein the insert comprises at least one selected from the group consisting of a stock insert, a featureless insert, and an arm brace insert.

4. The buffer tube cover assembly of claim 1, wherein:
the insert comprises an installed configuration;
the insert comprises at least one forward locating portion; and
the at least one forward locating portion engages a mechanical feature of the cover tube to secure the insert in the installed configuration.

5. The buffer tube cover assembly of claim 1, wherein the at least one forward protruding member comprises a pair of forward protruding members capable of deflecting toward one another when the insert is attached to the cover base assembly.

6. The buffer tube cover assembly of claim 1, wherein the cover base assembly comprises a lever motion stop member that restricts movement of the lever.

7. The buffer tube cover assembly of claim 1, wherein the cover base assembly comprises at least one locking interface designed to permanently secure the cover base assembly and the insert together.

8. The buffer tube cover assembly of claim 1, wherein the cover base assembly comprises at least one opening such that the at least one forward protruding member of the insert is accessible through the at least one opening.

9. The buffer tube cover assembly of claim 1, wherein the cover base assembly comprises at least one positioning member designed to engage with at least one locating portion of the insert.

10. The buffer tube cover assembly of claim 9, wherein the at least one positioning member comprises two symmetric positioning members.

11. The buffer tube cover assembly of claim 1, wherein the insert comprises at least one protrusion designed to interface with a corresponding opening of the cover tube.

12. A buffer tube cover assembly comprising:
a cover base assembly; and
an insert attached to the cover base assembly, wherein:
the cover base assembly comprises a cover tube and at least one pin;
the insert comprises a pair of forward protruding members capable of deflecting toward one another when the insert is attached to the cover base assembly;
the pair of forward protruding members extend more than half of a total length of the buffer tube cover assembly from rear to front; and
the insert is modular and removable from the cover base assembly.

13. The buffer tube cover assembly of claim 12, wherein the insert comprises at least one selected from the group consisting of a stock insert, a featureless insert, and an arm brace insert.

14. The buffer tube cover assembly of claim 12, wherein:
the insert comprises an installed configuration;
the insert comprises at least one forward locating portion; and
the at least one forward locating portion engages a mechanical feature of the cover tube to secure the insert in the installed configuration.

15. The buffer tube cover assembly of claim 12, wherein:
the pair of forward protruding members fit within an internal cavity of the cover base assembly such that part of the insert passes through an aft end of the cover base assembly; and
the pair of forward protruding members each comprise an at least partially cylindrical shape and are disposed in an upper portion of the cover base assembly adjacent to an interface with a buffer tube.

16. The buffer tube cover assembly of claim 12, wherein the cover base assembly comprises a lever motion stop member that restricts movement of a lever of the cover base assembly.

17. The buffer tube cover assembly of claim 12, wherein the cover base assembly comprises at least one locking interface designed to permanently secure the cover base assembly and the insert together.

18. The buffer tube cover assembly of claim 12, wherein the cover base assembly comprises at least one opening such that at least one of the pair of forward protruding members are accessible through the at least one opening.

19. The buffer tube cover assembly of claim 12, wherein the cover base assembly comprises at least one positioning member designed to engage with at least one locating portion of the insert.

20. The buffer tube cover assembly of claim 12, wherein the insert comprises at least one protrusion designed to interface with a corresponding opening of the cover tube.

* * * * *